US007575345B2

(12) United States Patent
Gauthier et al.

(10) Patent No.: US 7,575,345 B2
(45) Date of Patent: Aug. 18, 2009

(54) LAMP HOUSING ASSEMBLY

(75) Inventors: Benoît Gauthier, Drummondville (CA); Dominic Blanchette, Drummondville (CA); Sébastien Lafond, Drummondville (CA); Daniel Marcoux, St-Charles-de-Drummond (CA); Denis Maltais, Drummondville (CA); Daniel Bathalon, Drummondville (CA)

(73) Assignee: Venmar Ventilation, Inc, Drummondville, Quebec (CA)

( * ) Notice: Subject to any disclaimer, the term of this patent is extended or adjusted under 35 U.S.C. 154(b) by 111 days.

(21) Appl. No.: 11/649,340

(22) Filed: Jan. 3, 2007

(65) Prior Publication Data

US 2008/0158893 A1 Jul. 3, 2008

(51) Int. Cl.
*F21V 15/00* (2006.01)

(52) U.S. Cl. ..... 362/366; 362/287; 362/365; 362/427

(58) Field of Classification Search ..... 362/147, 362/148, 255, 287, 364, 365, 366, 418, 427, 362/429
See application file for complete search history.

(56) References Cited

U.S. PATENT DOCUMENTS

| | | | | |
|---|---|---|---|---|
| 2,716,185 | A * | 8/1955 | Burliuk et al. | 362/366 |
| RE24,258 | E | 12/1956 | Burliuk et al. | |
| 3,313,931 | A * | 4/1967 | Klugman | 362/366 |
| 3,697,742 | A * | 10/1972 | Bobrick | 362/366 |
| 5,124,901 | A * | 6/1992 | Sojka et al. | 362/366 |
| 5,377,087 | A | 12/1994 | Yoon | |
| 5,452,193 | A | 9/1995 | Hinnefeld et al. | |
| 6,364,511 | B1 | 4/2002 | Cohen | |
| 6,726,347 | B2 | 4/2004 | Wronski | |
| 6,799,908 | B1 | 10/2004 | Park et al. | |

* cited by examiner

*Primary Examiner*—Stephen F Husar
(74) *Attorney, Agent, or Firm*—Novak, Druce + Quigg

(57) ABSTRACT

A lamp housing assembly comprising two components, namely a mounting ring and a lamp socket holder housing. The mounting ring is snap interlockable with the lamp socket holder housing.

4 Claims, 25 Drawing Sheets

LAMP HOUSING ASSEMBLY

The present relates to a lamp housing assembly which may for example be used for kitchen hoods. The lamp housing assembly may in particular be used as part of a recessed downlight fixture which may be adapted for use in horizontal or inclined ceiling panels or plates of a kitchen hood (i.e. for the underside thereof above the stove heating elements). The present invention in particular relates to such fixtures which allow for the orientation of a lamp, during installation of the fixture, to be conveniently adjusted relative to the (ceiling) support panel in order to establish a desired lighting pattern.

Lamp housing assemblies are known which may be used as recessed fixtures and which have a socket housing for accommodating a socket for engagement with the attachment end of a (conventional) lamp; see for example U.S. Pat. No. 5,452,193. Lamp housing assemblies of such type are also known which provide for an adjustment of the lamp orientation; see for example U.S. Pat. Nos. RE 24,258, 5,377,087, 6,364,511, 6,726,347 and 6,779,908.

The known lamp housing assemblies which provide for adjustment of lamp orientation are, however, of complicated construction. It would be advantageous to have a lamp housing assembly of simple construction which may be locked in a predetermined fixed lamp orientation configuration at the outset of installation of the lighting assembly.

Thus present invention in a general aspect relates to a lamp housing assembly comprising two components, namely a mounting ring and a lamp socket holder housing. In accordance with two other general aspects the present invention also relates to the mounting ring and the lamp socket holder housing themselves. In accordance with other general aspects the present invention relates to a kit for a lamp housing assembly wherein the kit comprises a mounting ring and a lamp socket holder housing, the mounting ring being interlockable with the lamp socket holder housing.

In accordance with the present invention, the mounting ring and the lamp socket holder housing are interlockable by snap lock means. The snap lock means may take any desired or necessary form provided that the snap lock means interlocks the two components such that they form the desired assembly configuration (e.g. a unitary assembly), i.e. the snap lock means is configured to inhibit undesired disengagement of the two components relative to each other The snap lock means may for example inhibit both linear and angular displacement of the two components. The two components may be pre-assembled or may be assembled together just prior to installation of the assembly in a panel or plate of a kitchen hood or of other panel type support such as a wall, ceiling or floor. On the other hand, if so desired the snap lock means may configured so as to releasably interlock the two components together. In this case, if prior to installation, it is desired to alter the orientation of the socket holder housing (as discussed below) relative to the mounting ring or to replace the socket holder housing with a different housing, the two components may be disengageable for this purpose.

In accordance with the present invention a lamp housing assembly may be obtained from a mounting ring and a corresponding (predetermined) lamp socket holder housing which may provide for a lamp housing assembly with a predetermined single (fixed) lamp orientation configuration. In this case a lamp socket holder housing and a mounting ring may be configured to interlock so as to provide for only a single predetermined lamp orientation. Such a lamp assembly may for example provide for a conventional straight down (vertical) orientation of the lamp or if desired for an angled or oblique orientation of the lamp with respect to the vertical; the two components of this type of embodiment of the invention are of course not interlockable so as to provide for both of these orientations in the alternative.

In accordance with a further particular aspect of the present invention, the mounting ring and lamp socket holder housing (as well as the snap lock means associated thereof) may take any suitable (i.e. known) form which allows the two components to be interlocked in any one of a plurality or series of (i.e. two or more) fixed configurations whereby a lamp (engaged in the socket of the assembly) may be for oriented at one of a plurality of (i.e. one of two) discrete (predetermined) alternate fixed orientations for its operation or function.

The components of the lamp housing assembly may be of any desired or necessary material such as for example of a (suitable) plastics material.

Thus the present invention in accordance with one aspect provides a lamp housing assembly comprising a mounting ring interlocked with a lamp socket holder housing wherein said mounting ring comprises a lower rim member and an upper rim (or border) member, said lower rim member having a predetermined longitudinal, first, lamp orientation axis, said upper rim member comprising a first snap interlock element, wherein said lamp socket holder housing comprises an upper lamp/socket housing member and a lower rim member, said upper lamp/socket housing member having a predetermined longitudinal, second, lamp orientation axis, said lower rim member comprising a second snap interlock element the mounting ring and the lamp socket holder housing being configured such that the first and second snap interlock elements interlock together the mounting ring and the lamp socket holder housing in a predetermined configuration wherein the second lamp orientation axis is disposed in a predetermined orientation with respect to the first lamp orientation axis, said predetermined orientation being selected from the group consisting of an orientation parallel to (e.g. coincident with) the first lamp orientation axis and an orientation oblique to the first lamp orientation axis.

The present invention in accordance with another aspect provides a lamp socket holder housing interlockable with a mounting ring for forming a lamp hosing assembly, said mounting ring comprising a lower rim member and an upper rim (or border) member, said lower rim member having a predetermined longitudinal, first, lamp orientation axis, said upper rim member comprising first snap interlock element, said lamp socket holder housing comprising an upper lamp/socket housing member and a lower rim member, said upper lamp/socket housing member having a predetermined longitudinal, second, lamp orientation axis, said lower rim member comprising a second snap interlock element, and the lower rim member of said lamp socket holder housing being configured to cooperate with the upper rim member of said mounting ring such that the first and second snap interlock elements are able to interlock together the mounting ring and the lamp socket holder housing in a predetermined configuration wherein the second lamp orientation axis is disposed in a predetermined orientation with respect to the first lamp orientation axis, said predetermined orientation being selected from the group consisting of an orientation parallel to the first lamp orientation axis and an orientation oblique (i.e. not parallel no or perpendicular) to the first lamp orientation axis.

The present invention in accordance with a further aspect provides a mounting ring interlockable with a lamp socket holder housing for forming a lamp housing assembly, said lamp socket holder housing comprising an upper lamp/socket housing member and a lower rim member, said upper lamp/ socket housing member having a predetermined longitudinal, second, lamp orientation axis, said lower rim member comprising a second snap interlock element wherein said mounting ring comprises a lower rim member and an upper rim (or border) member, said lower rim member having a predetermined longitudinal, first, lamp orientation axis, said upper rim member comprising first snap interlock element, the upper rim member of said mounting ring being configured to cooperate with the lower rim member of said lamp socket holder housing such that the first and second snap interlock elements are able to interlock together the mounting ring and the lamp socket holder housing in a predetermined configuration wherein the second lamp orientation axis is disposed in a predetermined orientation with respect to the first lamp orientation axis, said predetermined orientation being selected from the group consisting of an orientation parallel to the first lamp orientation axis and an orientation oblique to the first lamp orientation axis.

The present invention in accordance with an additional aspect provides a lamp housing assembly comprising a mounting ring releasably interlocked with a lamp socket holder housing wherein said mounting ring comprises a lower rim member and an oblique upper rim (or border) member, said lower rim member having a predetermined longitudinal, first, lamp orientation axis, said oblique upper rim/border member being disposed obliquely with respect to said first lamp orientation axis, said oblique upper rim member comprising a first snap interlock element, wherein said lamp socket holder housing comprises an upper lamp/socket housing member and an oblique lower rim member, said upper lamp/socket housing member having a predetermined longitudinal, second, lamp orientation axis, said oblique lower rim member being disposed obliquely with respect to said second lamp orientation axis, said oblique lower rim member comprising a second snap interlock element and wherein the mounting ring and the lamp socket holder housing are configured such that the first and second snap interlock elements releasably interlock together the mounting ring and the lamp socket holder housing in a first configuration or in a second configuration, wherein when said mounting ring and said lamp socket holder housing are interlocked together in said first configuration the lamp socket holder housing is oriented such that the second lamp orientation axis is parallel to the first lamp orientation axis and wherein when said mounting ring and said lamp socket holder housing are interlocked together in said second configuration the lamp socket holder housing is oriented such that the second lamp orientation axis is oblique to the first lamp orientation axis.

The present invention in accordance with another aspect further provides a lamp socket holder housing for a lamp hosing assembly comprising said lamp socket holder housing interlocked with a mounting ring, said mounting ring comprising a lower rim member and an oblique upper rim/border member, said lower rim member having a predetermined longitudinal, first, lamp orientation axis, said oblique upper rim/border member being disposed obliquely with respect to said first lamp orientation axis, said oblique upper rim member comprising first snap interlock element, said lamp socket holder housing comprising an upper lamp/socket housing member and an oblique lower rim member, said upper lamp/socket housing member having a predetermined longitudinal, second, lamp orientation axis, said oblique lower rim member disposed obliquely with respect to said second lamp orientation axis, said oblique lower rim member comprising a second snap interlock element, and the oblique lower rim member of said lamp socket holder housing being configured to cooperate with the oblique upper rim member of said mounting ring such that the first and second snap interlock elements are able to interlock together the mounting ring and the lamp socket holder housing in a first configuration or in a second configuration, wherein when said mounting ring and said lamp socket holder housing are interlocked together in said first configuration the lamp socket holder housing is oriented relative to said mounting ring such that the second lamp orientation axis is parallel to the first lamp orientation axis and wherein when said mounting ring and said lamp socket holder housing are interlocked together in said second configuration the lamp socket holder housing is oriented relative to said mounting ring such that the second lamp orientation axis is oblique to the first lamp orientation axis.

The present invention in accordance with another aspect also provides a mounting ring for a lamp housing assembly comprising said mounting ring interlocked with a lamp socket holder housing, said lamp socket holder housing comprising an upper lamp/socket housing member and an oblique lower rim member, said upper lamp/socket housing member having a predetermined longitudinal, second, lamp orientation axis, said oblique lower rim member disposed obliquely with respect to said second lamp orientation axis, said oblique lower rim member comprising a second snap interlock element wherein said mounting ring comprises a lower rim member and an oblique upper rim/border member, said lower rim member having a predetermined longitudinal, first, lamp orientation axis, said oblique upper rim/border member disposed obliquely with respect to said first lamp orientation axis, said oblique upper rim member comprising first snap interlock element, the oblique upper rim member of said mounting ring being configured to cooperate with the oblique lower rim member of said lamp socket holder housing such that the first and second snap interlock elements are able to interlock together the mounting ring and the lamp socket holder housing in a first configuration or in a second configuration, wherein when said mounting ring and said lamp socket holder housing are interlocked together in said first configuration the lamp socket holder housing is oriented such that the second lamp orientation axis is parallel to the first lamp orientation axis and wherein when said mounting ring and said lamp socket holder housing are interlocked together in said second configuration the lamp socket holder housing is oriented such that the second lamp orientation axis is oblique to the first lamp orientation axis.

The present invention in accordance with an additional aspect provides a kit for a lamp housing assembly, said kit comprising a mounting ring and a lamp socket holder housing wherein said mounting ring comprises a lower rim member and an upper rim/border member, said lower rim member having a predetermined longitudinal, first, lamp orientation axis, said oblique upper rim member comprising a first snap interlock element, wherein said lamp socket holder housing comprises an upper lamp/socket housing member and a lower rim member, said upper lamp/socket housing member having a predetermined longitudinal, second, lamp orientation axis, said lower rim member comprising a second snap interlock element the mounting ring and the lamp socket holder housing being configured such that the first and second snap interlock elements are able to interlock together the mounting ring and the lamp socket holder housing in a predetermined configuration wherein the second lamp orientation axis is disposed in a predetermined orientation with respect to the first lamp orientation axis, said predetermined orientation being selected from the group consisting of an orientation parallel to the first lamp orientation axis and an orientation oblique to the first lamp orientation axis.

The present invention in accordance with a further additional aspect provides a kit for a lamp housing assembly, said kit comprising a mounting ring and a lamp socket holder housing wherein said mounting ring comprises a lower rim member and an oblique upper rim (or border) member, said lower rim member having a predetermined longitudinal, first, lamp orientation axis, said oblique upper rim (or border) member being disposed obliquely with respect to said first lamp orientation axis, said oblique upper rim member comprising a first snap interlock element, wherein said lamp socket holder housing comprises an upper lamp/socket housing member and an oblique lower rim member, said upper lamp/socket housing member having a predetermined longitudinal, second, lamp orientation axis, said oblique lower rim member being disposed obliquely with respect to said second lamp orientation axis, said oblique lower rim member comprising a second snap interlock element and wherein the mounting ring and the lamp socket holder housing are configured such that the first and second snap interlock elements are able to releasably interlock together the mounting ring and the lamp socket holder housing in a first configuration or in a second configuration, wherein when said mounting ring and said lamp socket holder housing are interlocked together in said first configuration the lamp socket holder housing is oriented such that the second lamp orientation axis is parallel to the first lamp orientation axis and wherein when said mounting ring and said lamp socket holder housing are interlocked together in said second configuration the lamp socket holder housing is oriented such that the second lamp orientation axis is oblique to the first lamp orientation axis.

The lamp housing assembly may as desired or necessary also include attachment means for attachment of the assembly to a support structure. The attachment means may take on any suitable form. The attachment means may for example comprise tabs having openings for the engagement of screw or the like; the tabs may for example form part of a trim ring of the lower rim member of the mounting ring. The lower rim member of the mounting ring may include projections which along with a trim ring may engage opposite sides of the peripheral edge of an opening in a panel of a kitchen hood for example (see below).

The invention will be discussed hereinafter with respect to the drawings which illustrate an example embodiment of the invention wherein the same two components (i.e. one mounting ring and one lamp socket holder housing) are able to provide for two discrete alternate fixed lamp orientation configurations for a lamp housing assembly. For this purpose (as shall be discussed below) the two components shown in the drawings each have oblique rim members which are disposed obliquely with respect to the respective first and second lamp orientation axii.

On the other hand, as an alternative embodiment, the mounting ring and the lamp socket holder housing of the assembly may be modified such that the upper rim member of the mounting ring and the lower rim member of the lamp socket holder housing may be disposed such that one or both may be perpendicular to a respective first or second lamp orientation axis. In this case the flexibility of two discrete fixed lamp orientation configurations may, for example, be provided from three components (not two) namely either a single mounting ring and two socket holder housings or a single socket holder housing and two mounting rings. For example, the mounting ring may have an upper rim member perpendicular to the first lamp orientation axis whereas one of the two lamp socket holder housings (holder housing A) will have a lower rim member which is perpendicular to the second lamp orientation axis and the other socket holder housing (holder housing B) will have a lower rim member which is oblique to the second lamp orientation axis. For this embodiment in order to have an assembly wherein the first and second lamp orientation axis are parallel the mount ring will be interlocked with the housing A. On the other hand, in order to have an assembly wherein the first and second lamp orientation axis are oblique, the mount ring will be interlocked with the housing B. In any case, the same snap lock means as discussed below for the illustrated embodiment of the invention may be exploited for the above mentioned alternative embodiment.

In the drawings which illustrate an example embodiment of the invention:

As mentioned above, the invention will be discussed hereinafter with respect to the drawings which illustrate an example embodiment of the invention wherein the same mounting ring and the same lamp socket holder housing may be used to provide a lamp housing assembly having two discrete alternate fixed lamp orientation configurations.

Figure 9:
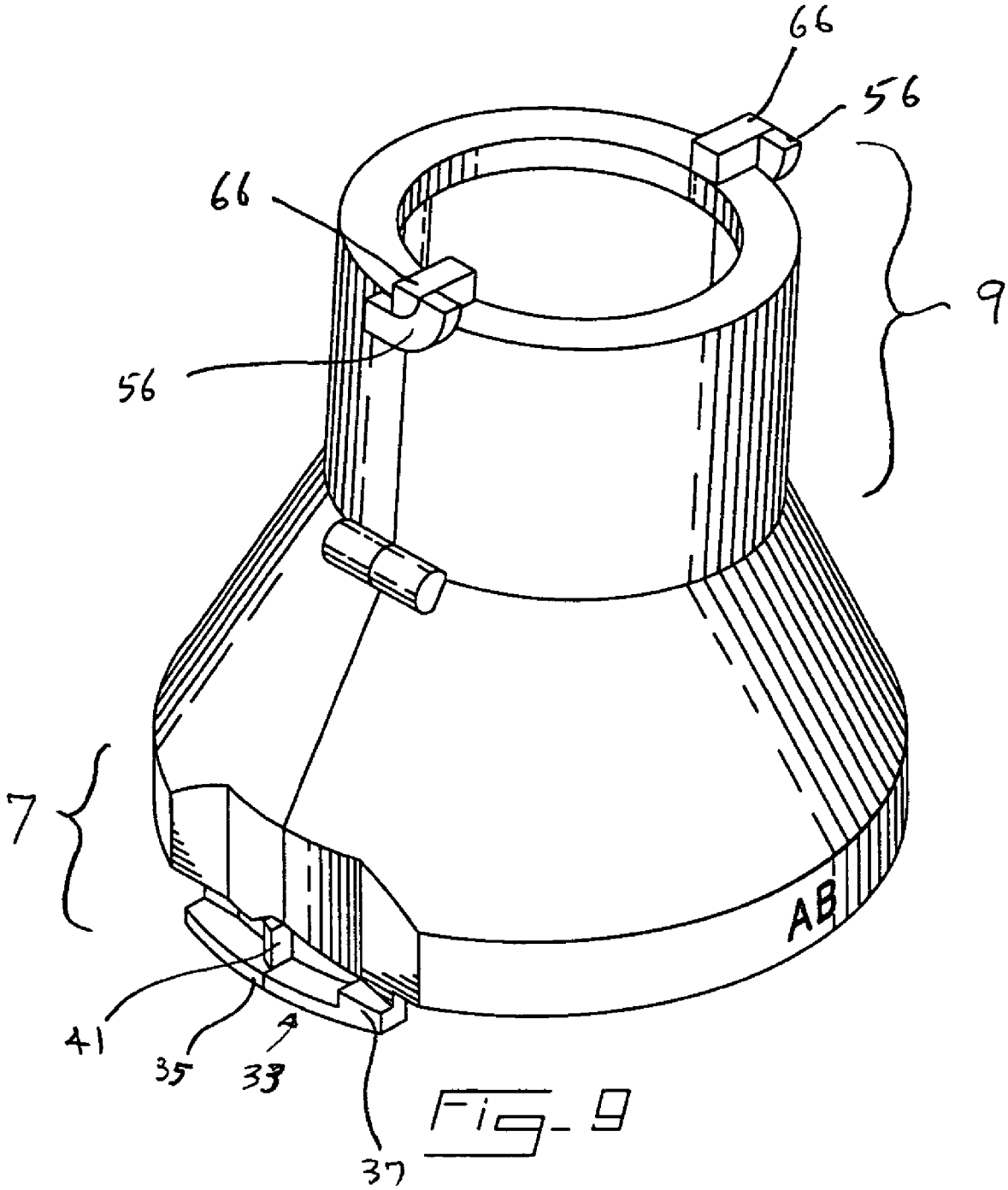
FIG. 9 is a top perspective view of the lamp socket holder housing comprising the two half elements of FIGS. 1 to 4.
Figure 16A:
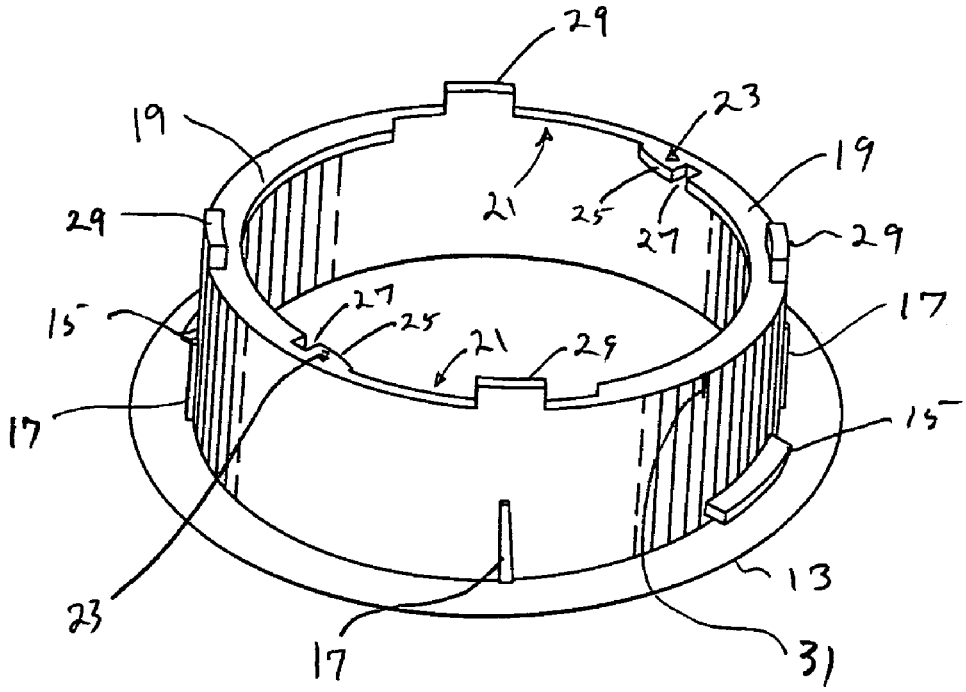
FIG. 16A is a top perspective view of an example mounting ring in accordance with the present invention.
Figure 16B:
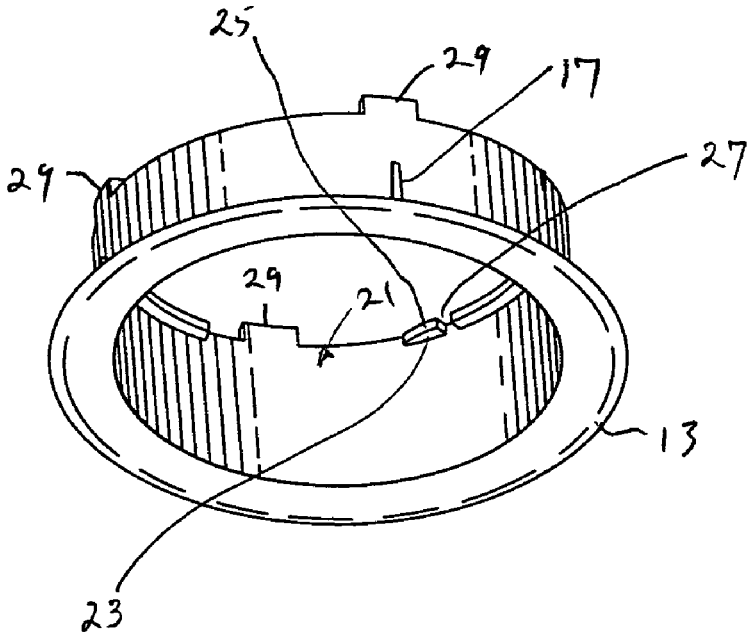
FIG. 16B is a bottom perspective view of the mounting ring of FIG. 16A.
Figure 17:
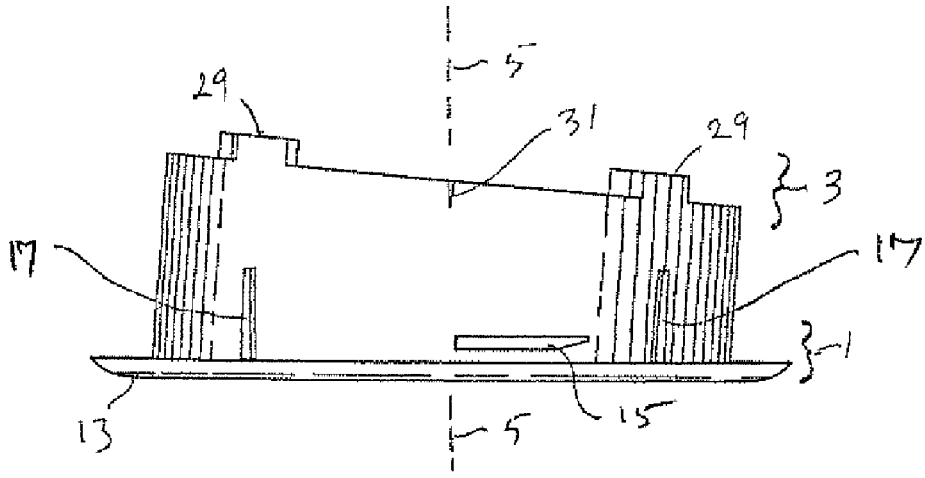
FIG. 17 is a side view of the mounting ring of FIG. 16A.
Figure 18:
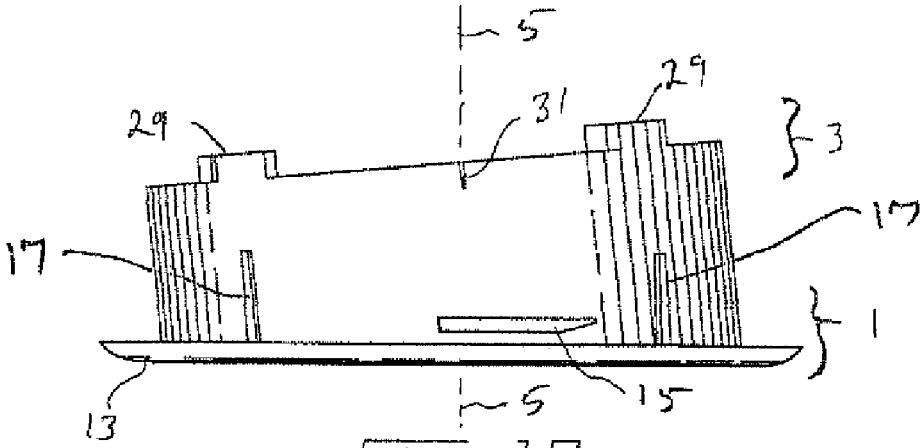
FIGS. 18 to 20 are also side views of the mounting ring of FIG. 16A wherein the views are each viewed progressively at 90 degree intervals starting from the view of FIG. 16A.
Figure 19:
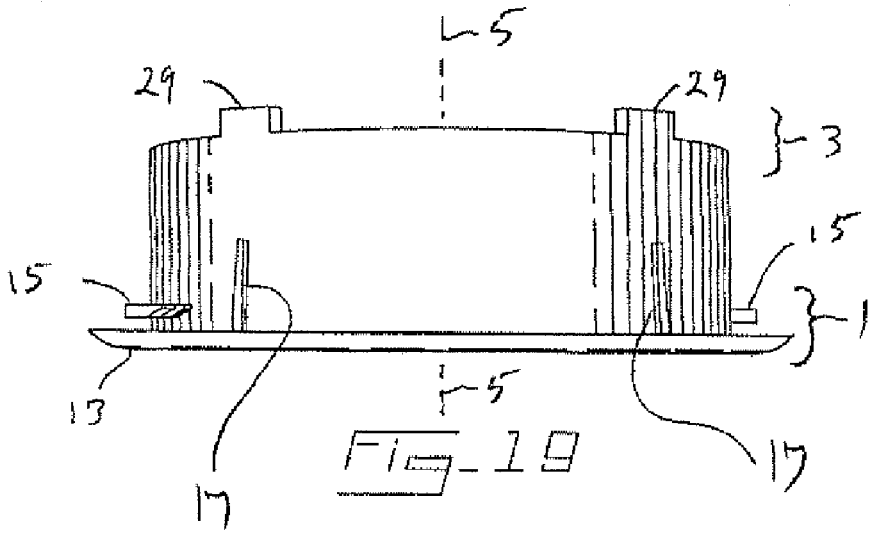
Figure 20:
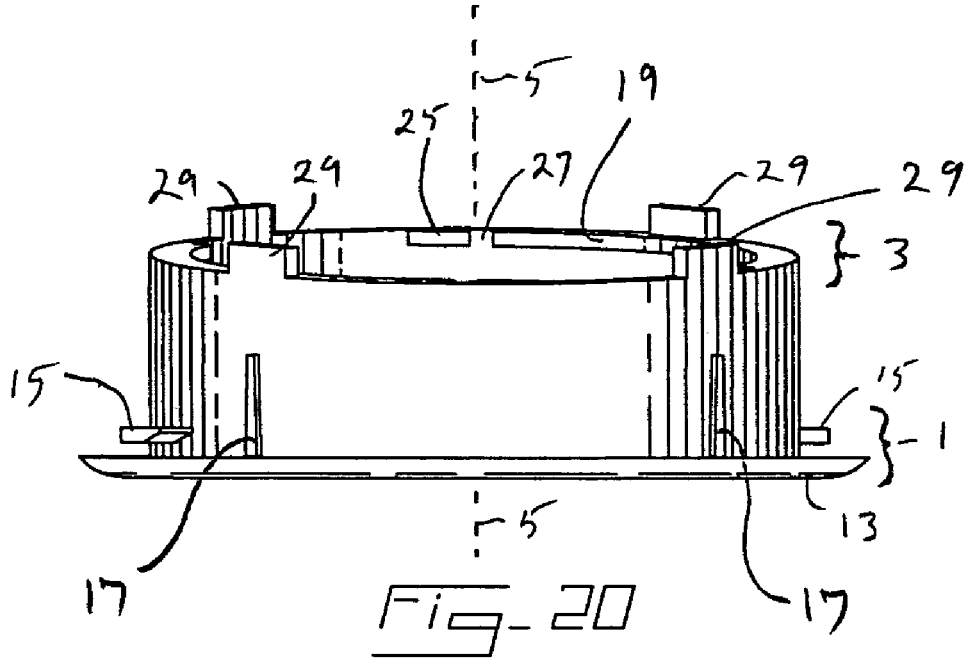
Figure 21:
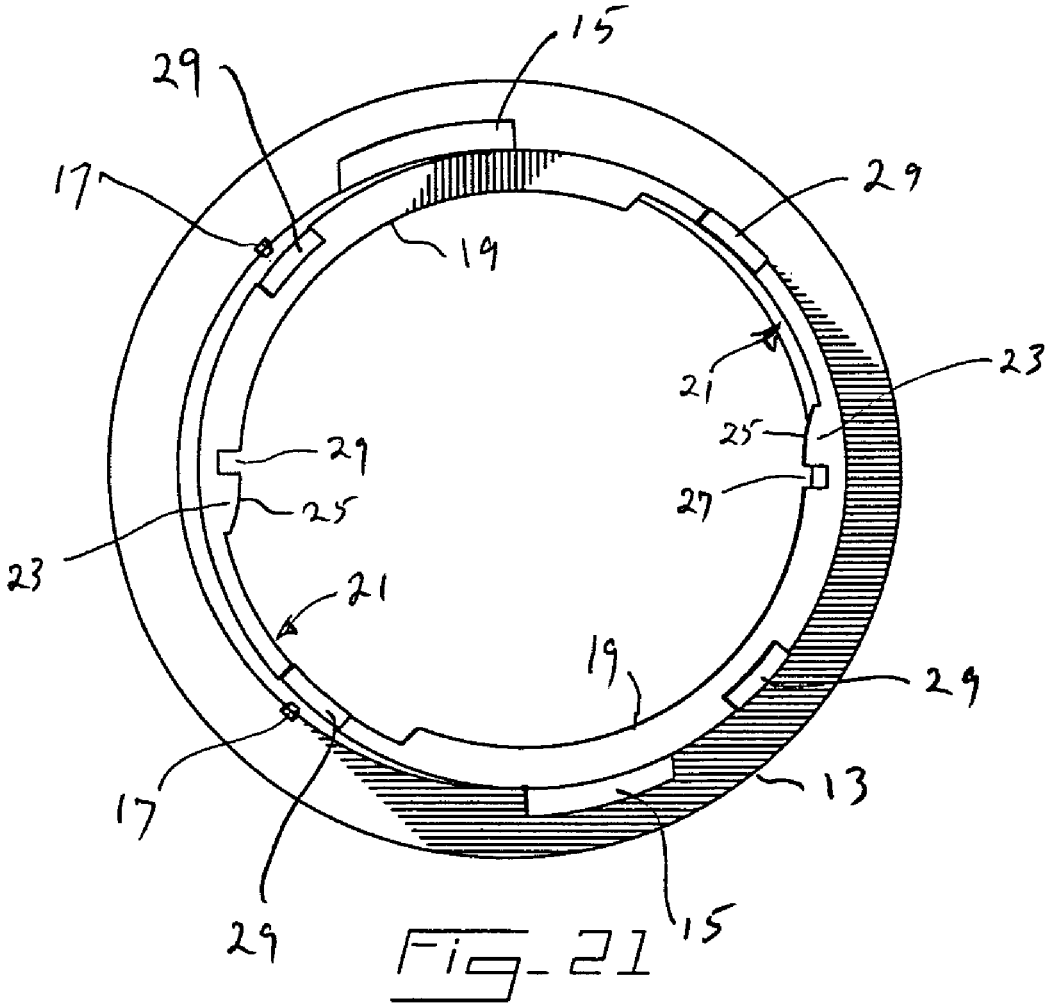
FIG. 21 is a top view of the mounting ring of FIG. 16A.

The mounting ring is shown in FIG. 16A in an upper perspective view. The lamp socket housing is shown in FIG. 9 also in an upper perspective view.

Referring to FIGS. 17, 18, 19, 20 and 32 the mounting ring has a lower rim (or border) member 1 and an oblique upper rim (or border) member 3. The lower rim member 1 defines an essentially circular opening and has a predetermined (i.e. central) longitudinal, first, lamp orientation axis 5. The lower rim member 1 of the example embodiment, is shown as being disposed essentially perpendicular to the first, lamp orientation axis 5. As may in particular be seen from FIGS. 17 and 18, the oblique or inclined upper rim member 3 is disposed obliquely with respect to the first lamp orientation axis; in other words the upper rim member is disposed so as to be neither parallel nor perpendicular to first lamp orientation axis. The upper rim member likewise defines an essentially circular opening.

Figure 10:
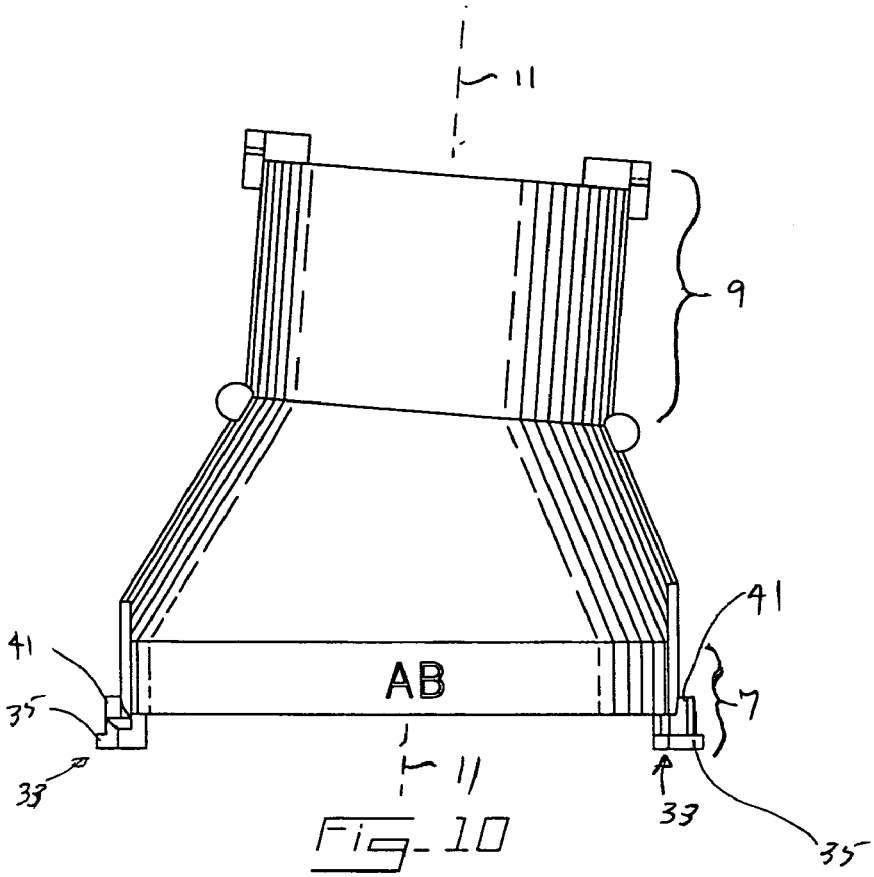
FIG. 10 is a side view of the lamp socket holder housing of FIG. 9.
Figure 11:
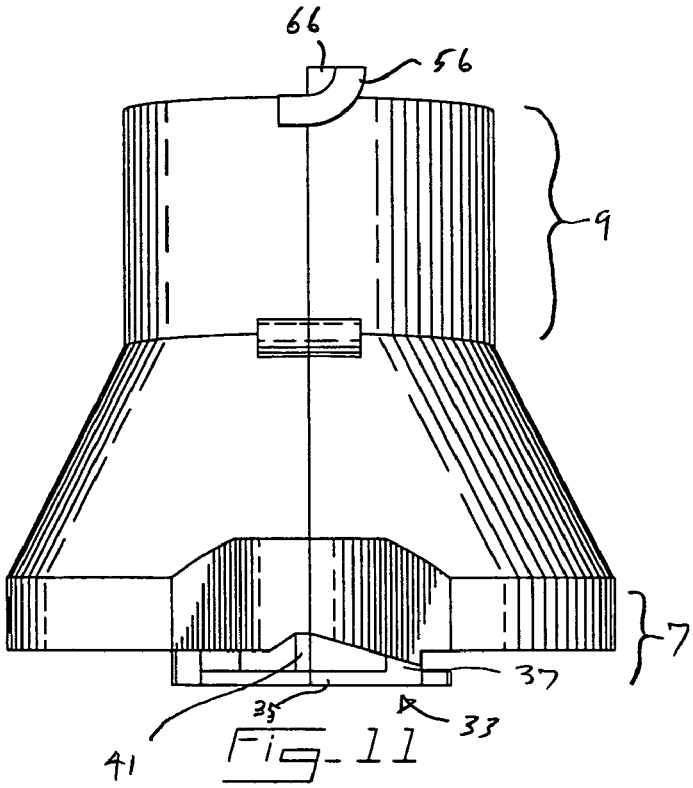
FIGS. 11 to 13 are also side views of the lamp socket holder housing of FIG. 9 wherein the views are each viewed progressively at 90 degree intervals starting from the view of FIG. 10.
Figure 12:
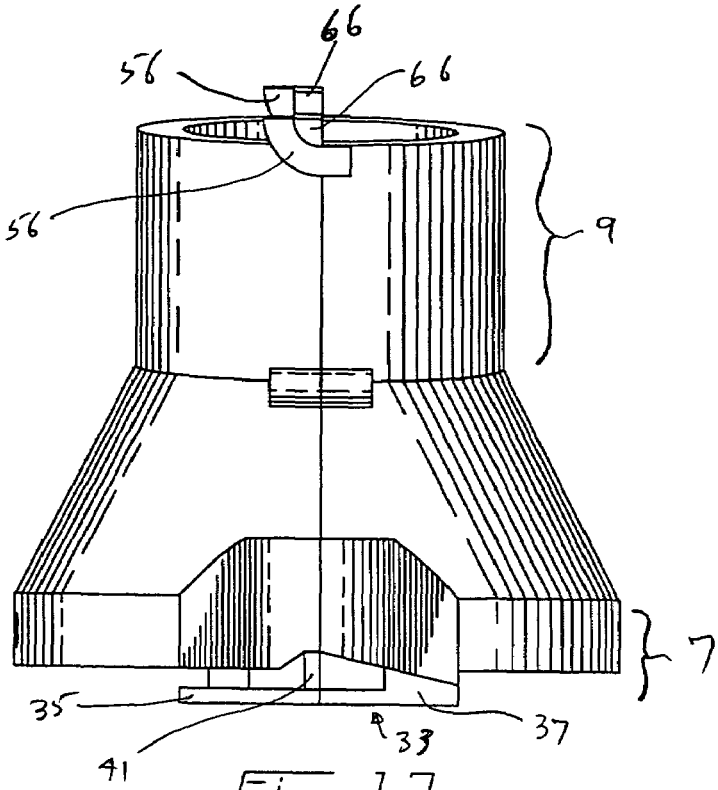
Figure 13:
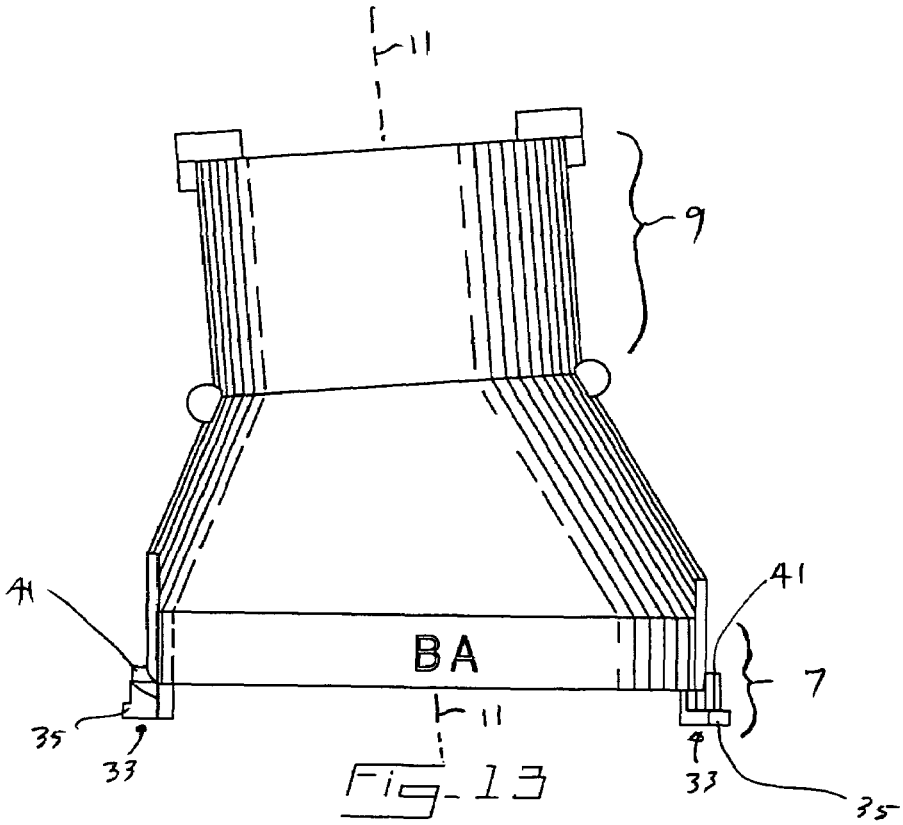
Figure 14:
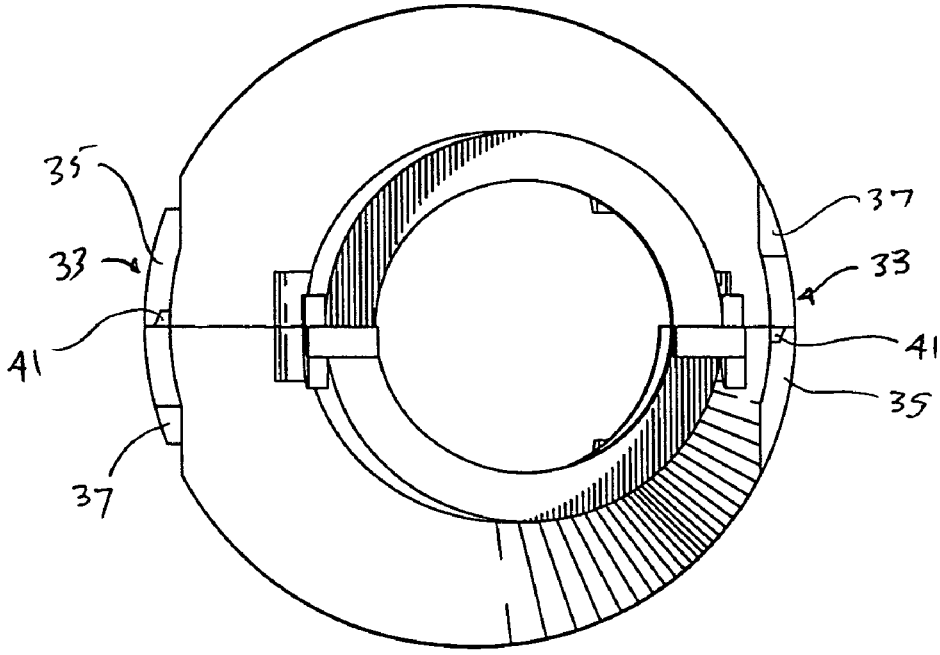
FIG. 14 is a top view of the lamp socket holder housing of FIG. 9.
Figure 15:
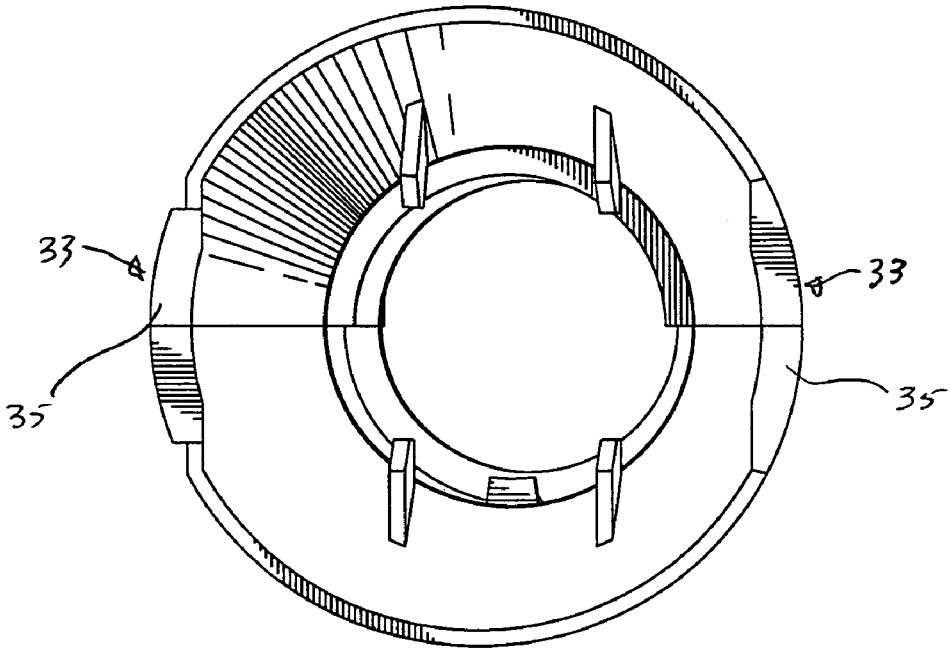
FIG. 15 is a bottom view of the lamp socket holder housing of FIG. 9.
Figure 43:
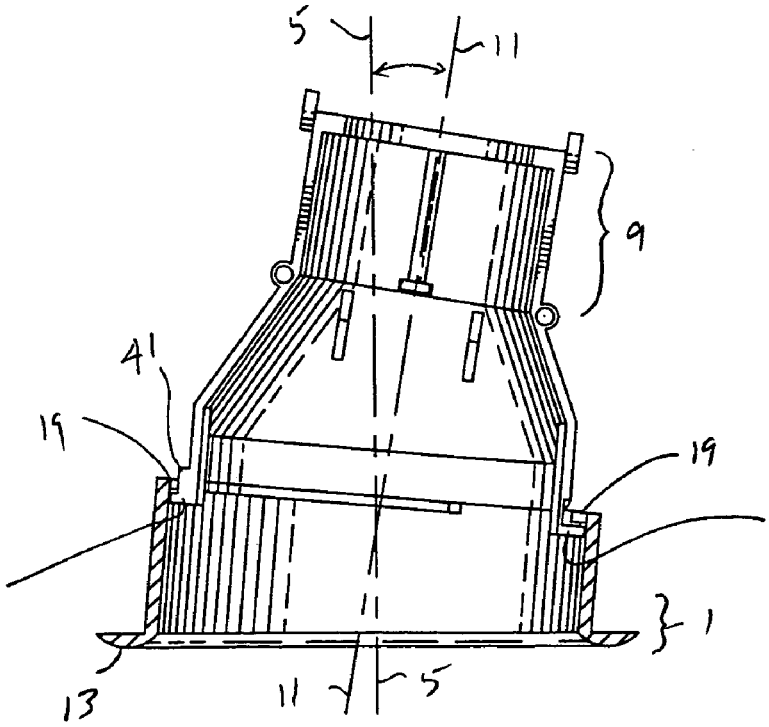
FIG. 43 is a sectional view of the lamp housing assembly of FIG. 37 along 43-43.

Referring to FIGS. 10, 13 and 43, the lamp socket housing has an oblique lower rim (or border) member 7 and an upper lamp/socket housing member 9. The upper lamp/socket housing member 9 comprises a continuous wall of essentially circular cross-section along its length i.e. it has the aspect of a hollow cylinder having a predetermined (i.e. central) longitudinal, second, lamp orientation axis 11. As may in particular be seen from FIGS. 10 and 13, the oblique or inclined lower rim member 7 is disposed obliquely with respect to the second lamp orientation axis 11; in other words the lower rim member 7 is disposed so as to be neither parallel nor perpendicular to the second lamp orientation axis 11. The lower rim member 7 likewise defines an essentially circular opening (see the bottom view of FIG. 15).

Figure 25:
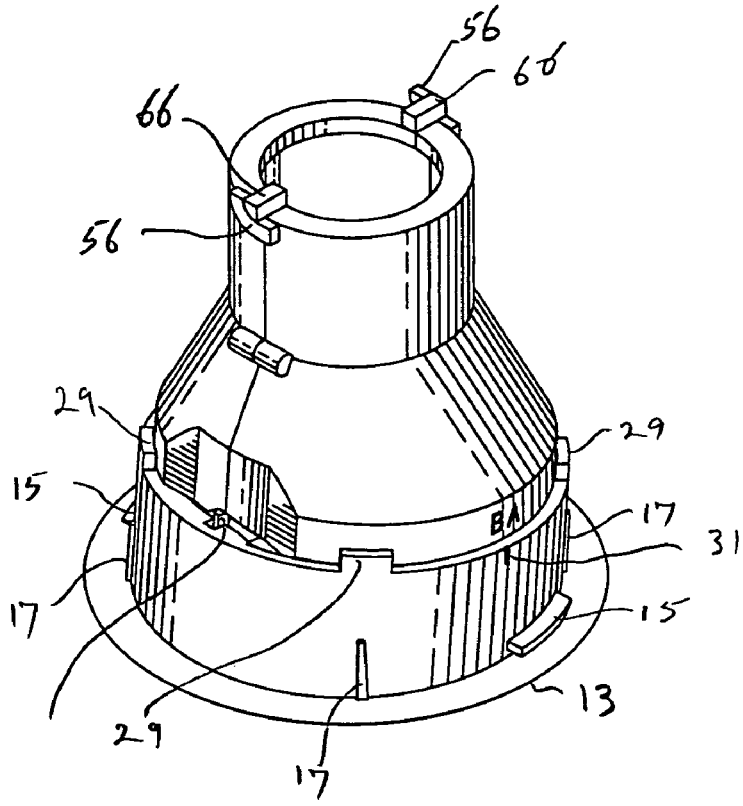
FIG. 25 is a top perspective view of the interlocked assembly derived from the pre-interlocked assembly of FIG. 24.
Figure 36:
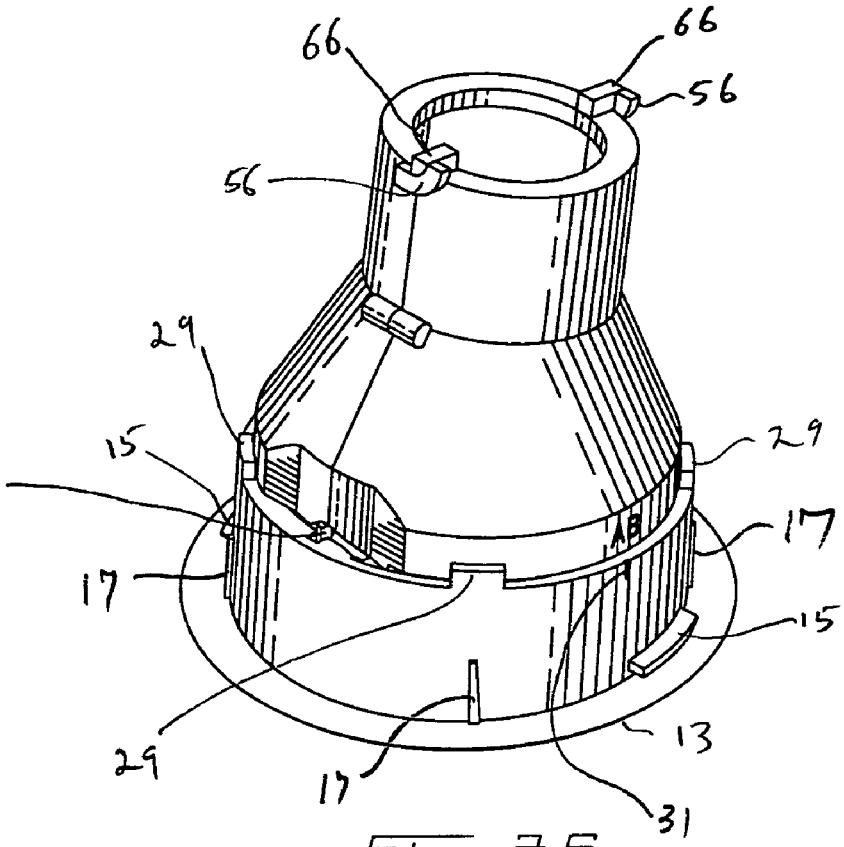
FIG. 36 is a top perspective view of the interlocked assembly of derived from the pre-interlocked assembly of FIG. 35.
Figure 37:
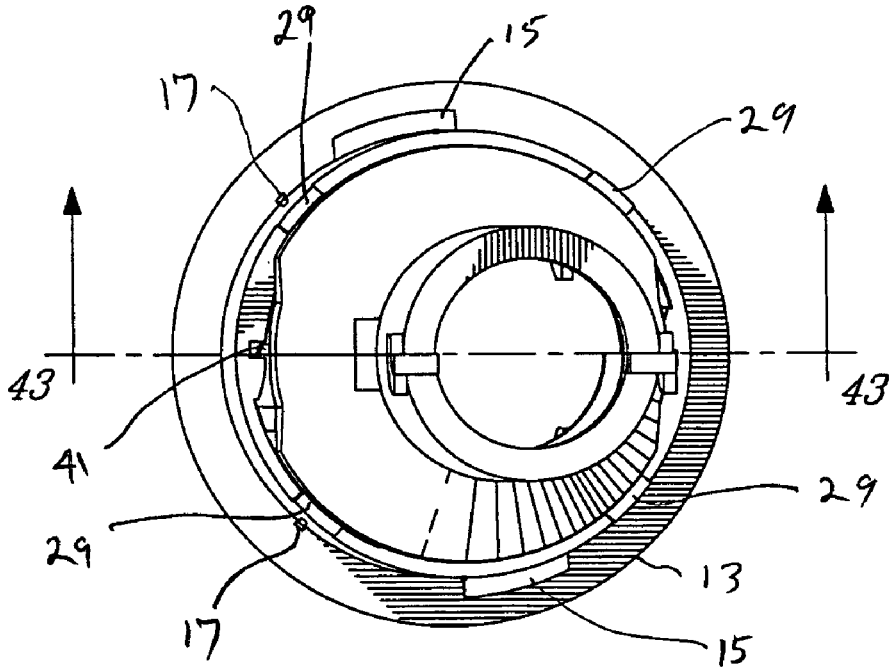
FIG. 37 is a top view of the lamp housing assembly of FIG. 36.

The mounting ring and the lamp socket holder assembly may be interlocked (as discussed herein) so as to provide an assembly having the aspect as shown in FIG. 25 or an assembly having the alternate aspect as set forth in FIG. 36.

As may be appreciated herein, the mounting ring and the lamp socket holder housing have a predetermined configuration wherein they may be interlocked such that the second lamp orientation axis 11 may be disposed in a one of two discrete predetermined orientations with respect to the first lamp orientation axis 5. Thus referring to FIGS. 27 and 28 as well as FIG. 32, these figures show a lamp housing assembly having a predetermined orientation for a lamp (not shown) engaged with a socket (also not shown) disposed in the upper lamp/socket housing member 9 wherein the second lamp orientation axis 11 is oriented parallel (i.e. substantially coincident) with the first lamp orientation axis 5. On the other hand, referring to FIG. 38, 39 as well as FIG. 43, these figures show a lamp housing assembly having a predetermined orientation for a lamp (not shown) engaged with a socket (also not shown) disposed in the upper lamp/socket housing 9 wherein the second lamp orientation axis 11 is oriented obliquely to the first lamp orientation axis 5. In the FIGS. 38, 39 and 43, for illustration purposes, the inclination of the second lamp orientation 11 is schematically highlighted by the reference to the double headed arrow.

Thus as gleaned from the above and from the drawings, the illustrated mounting ring and lamp socket holder housing each have oblique rim members which are disposed obliquely with respect to the respective first and second lamp orientation axii.

Referring to FIGS. 16A, 16B, and 17 to 21, the mounting ring as mentioned has a lower rim (or border) member 1 and an oblique upper rim (or border) member 3.

The lower rim member 1 has a trim ring 13 which extends outwardly from the mounting ring wall. The lower rim member 1 includes side wall projections 15 which along with the trim ring 13 may engage (i.e. pinch) opposite sides of the peripheral edge of an opening in a support panel of a kitchen hood for example (see below). The lower rim member 1 further includes wedge projections 17 also for engagement with the peripheral edge of the opening in the support panel.

The upper rim (or border) member 3 includes a (first) snap interlock element which includes two opposed retainer flange (or lip) members 19. The retainer flange members 19 extend inwardly from the mounting ring wall and are spaced apart so as to provide opposed passageways 21 therebetween for receiving (axial) retainer members of the (second) snap interlock element of the lamp socket holder housing. The retainer flange members 19 each have a sloped ramp member 23 having an interior cam surface portion 25 terminating in a lock notch 27. The upper rim member 3 is also provide with four alignment projections 29 disposed about the periphery of the mounting ring wall for assisting in the alignment of the oblique lower rim member 7 of the lamp socket holder housing into engagement with the upper rim member 3 of the mounting ring. The upper rim member 3 of the mounting ring is further provided with a configuration indicator element (i.e. a pair of opposed indicator notches 31) configured and disposed to cooperate with corresponding indicator elements of the lamp socket holder housing so as to provide an quick indication of the orientational disposition of the two components of the lamp housing assembly during the interlock process, i.e. so as to facilitate the assembly the two lamp assembly components.

Referring to FIGS. 9 to 15 the lamp socket holder housing as mentioned above has an oblique lower rim (or border) member 7 and an upper lamp/socket housing member 9. The upper lamp/socket housing member 9 is hollow for accommodating a lamp socket (not shown) for engagement of the attachment end of a lamp in the lamp housing assembly.

Figure 31:
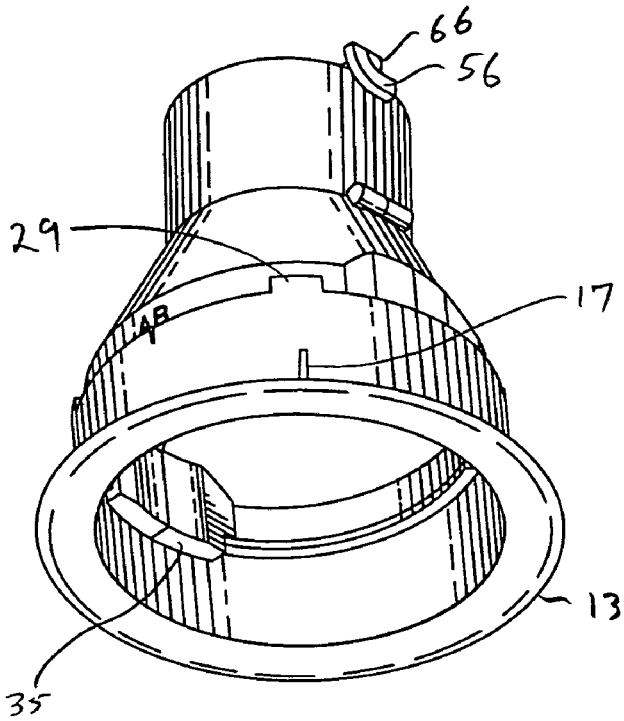
FIG. 31 is a bottom perspective view of the lamp housing assembly of FIG. 25.
Figure 32:
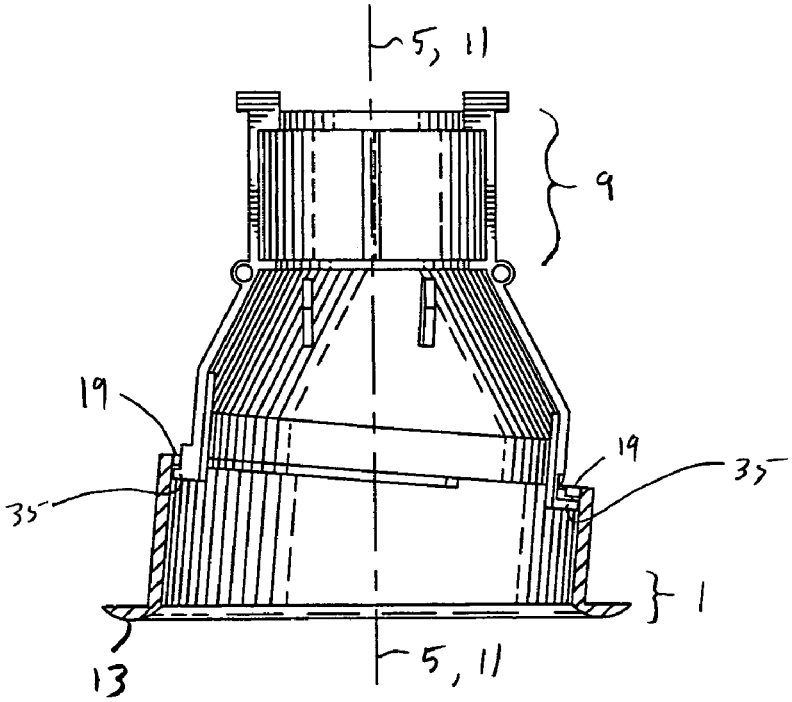
FIG. 32 is a sectional view of the lamp housing assembly of FIG. 26 along 32-32.

The lower rim member 7 is provided with a (second) snap interlock element which includes two opposed axially extending retainer legs 33 configured for registration with a respective passageway 21 separating the two retainer flange members 19 of the mounting ring. The retainer legs 33 each include outwardly extending axial retainer members 35 (i.e. flanges) which give the retainer legs 33 an L-shaped cross-sectional aspect while terminating at one end with a bumper member (see FIG. 9) 37. The axial retainer members 35 are configured and disposed such that when the retainer legs register with the above mentioned passageways 21 the axial retainer members 35 are below the retainer flange members 19 of the mounting ring (see FIGS. 31 and 32 as well as 42 and 43). The retainer legs also each have a latch projection member 41 adapted to ride on the cam surface portion 35 of a respective ramp member 23 of the mounting ring and to snap lock into said lock notch 27 of the mounting ring to interlock the mounting ring and the lamp socket holder housing together so as to inhibit axial as well as angular (i.e. rotation) displacement relative to each other.

Figure 6:
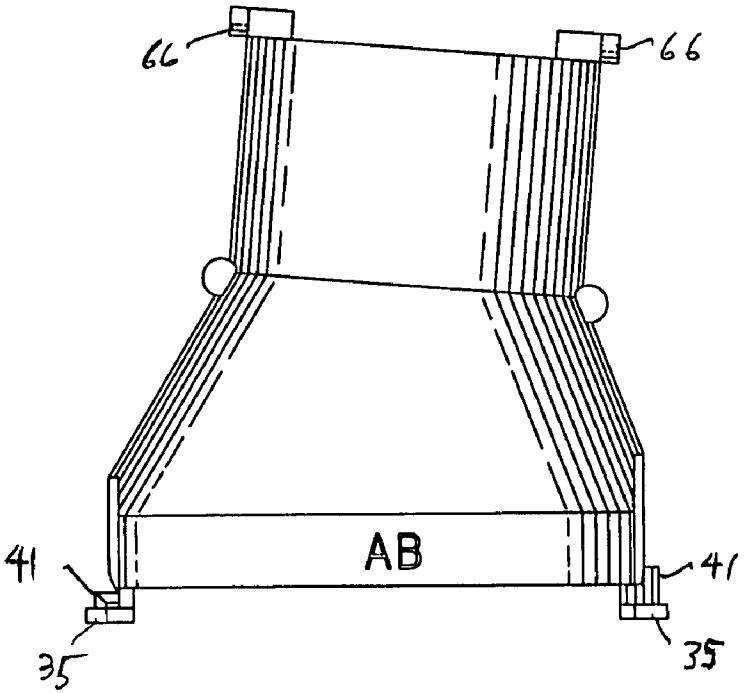
FIG. 6 is a side view of the half element of FIGS. 3 and 4.
Figure 5:
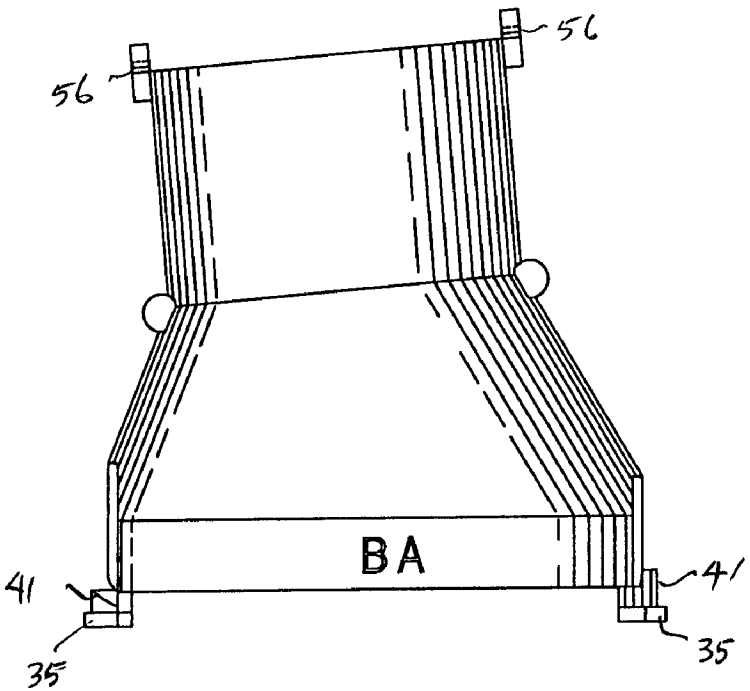
FIG. 5 is a side view of the half element of FIGS. 1 and 2.

The lower rim member 7 of the lamp socket holder housing is further provided with a pair of configuration indicator elements (i.e. a pair of opposed indicator letters AB and BA—see FIGS. 5 and 6) configured and disposed to cooperate with the corresponding indicator notches 31 of the mounting ring.

Figure 27:
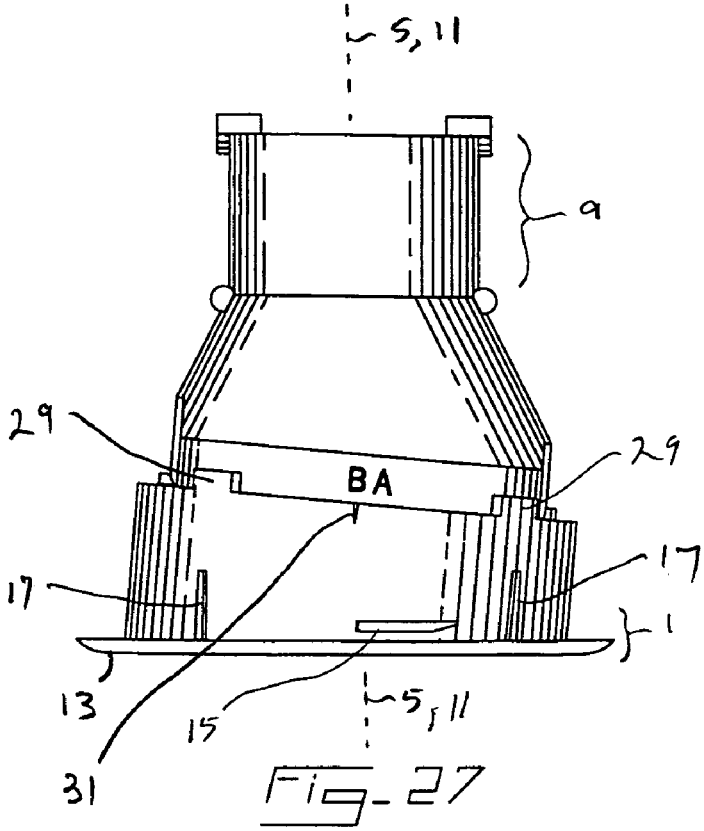
FIG. 27 is a side view of the lamp housing assembly of FIG. 25.
Figure 28:
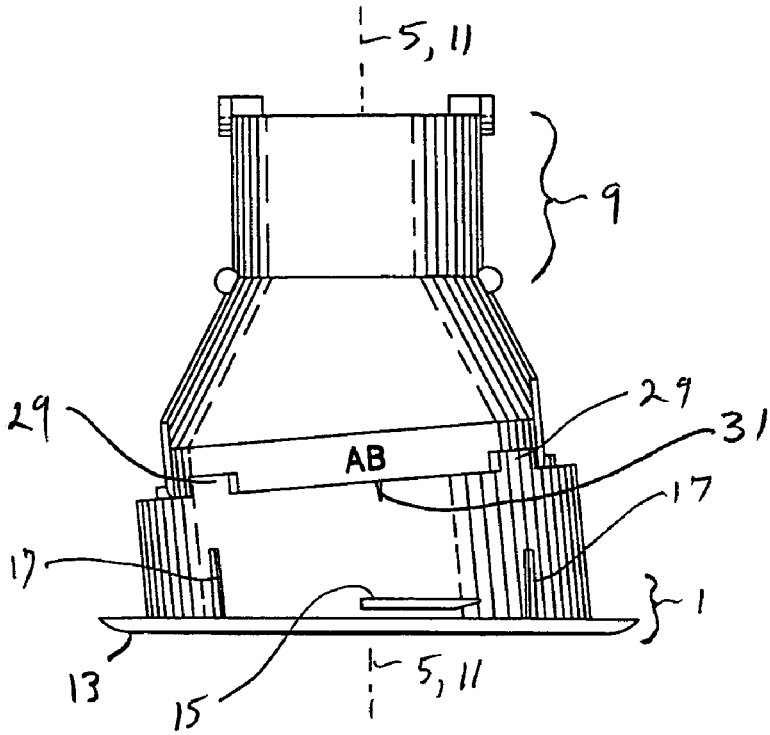
FIGS. 28 to 30 are also side views of the lamp housing assembly of FIG. 25 wherein the views are each viewed progressively at 90 degree intervals starting from the view of FIG. 27.
Figure 29:
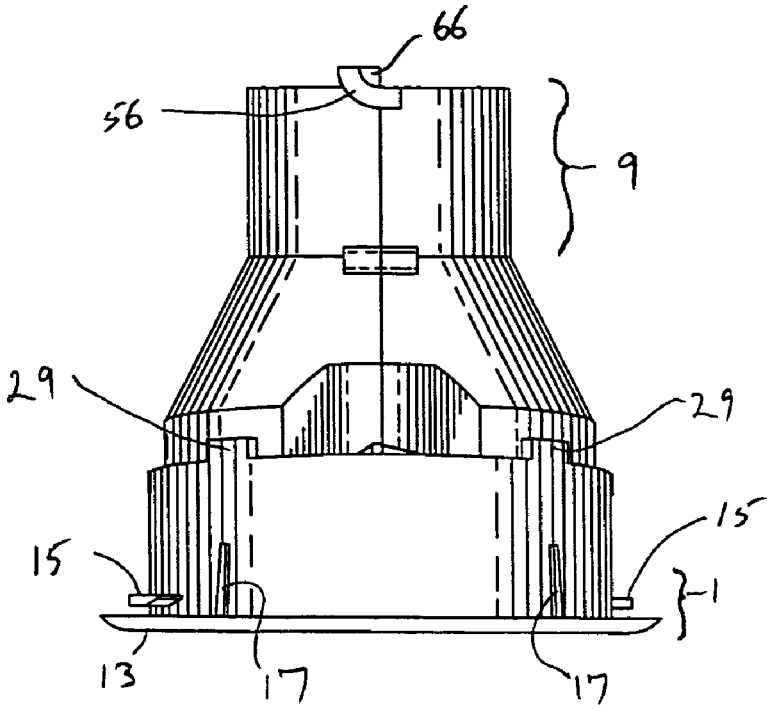
Figure 30:
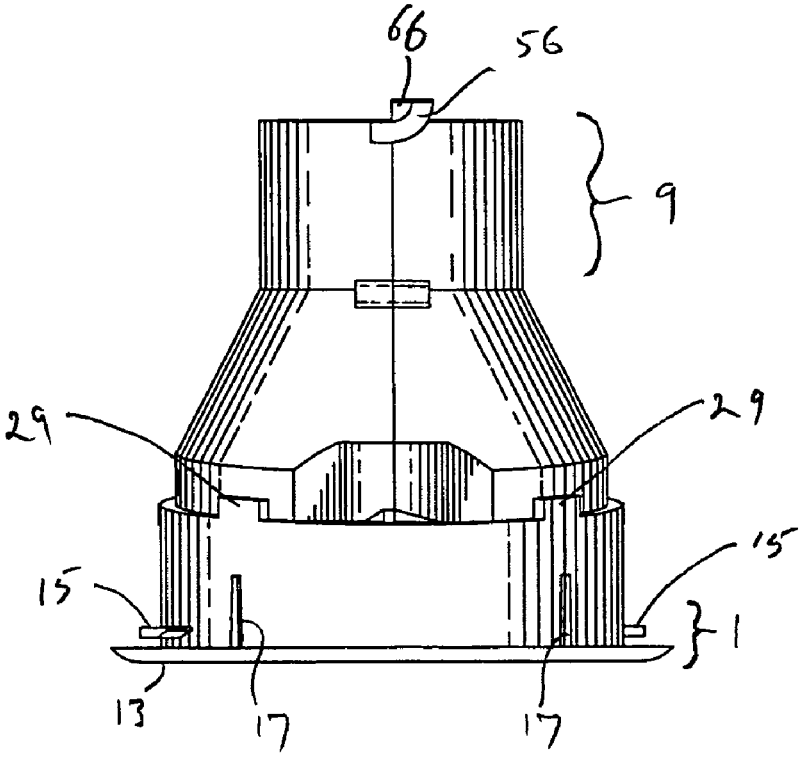
Figure 38:
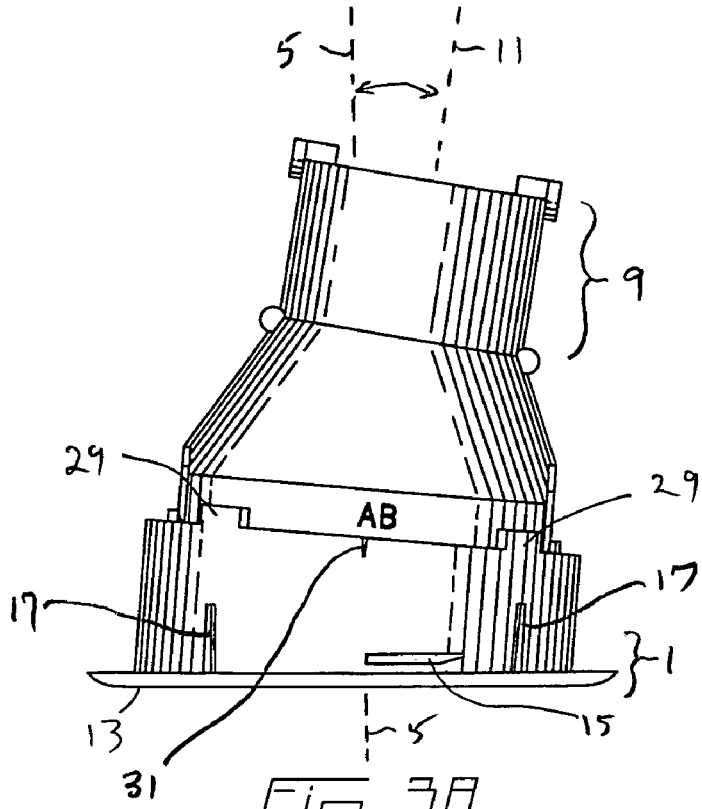
FIG. 38 is a side view of the lamp housing assembly of FIG. 36.
Figure 39:
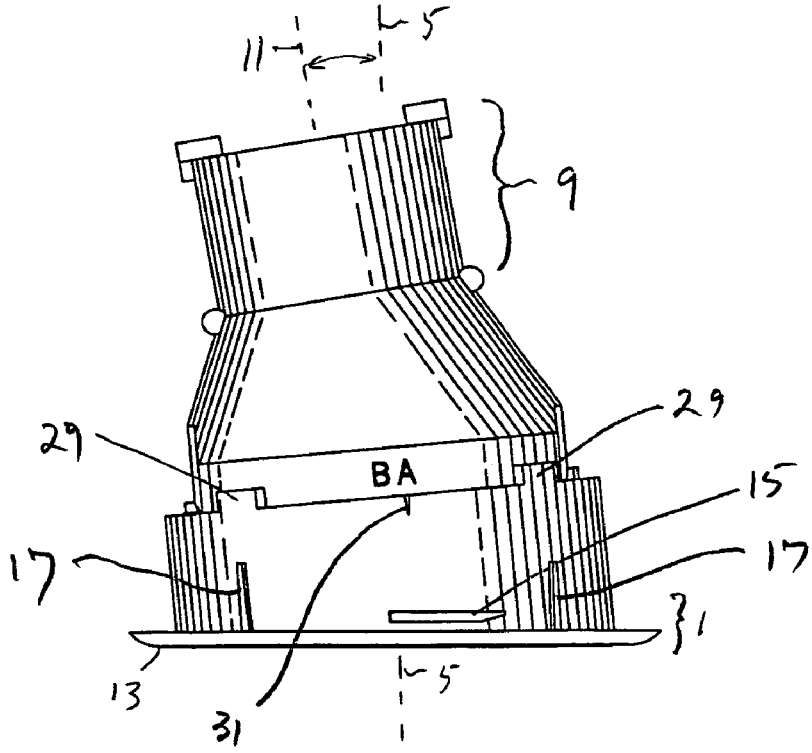
FIGS. 39 to 41 are also side views of the lamp housing assembly of FIG. 36 wherein the views are each viewed progressively at 90 degree intervals starting from the view of FIG. 38.
Figure 40:
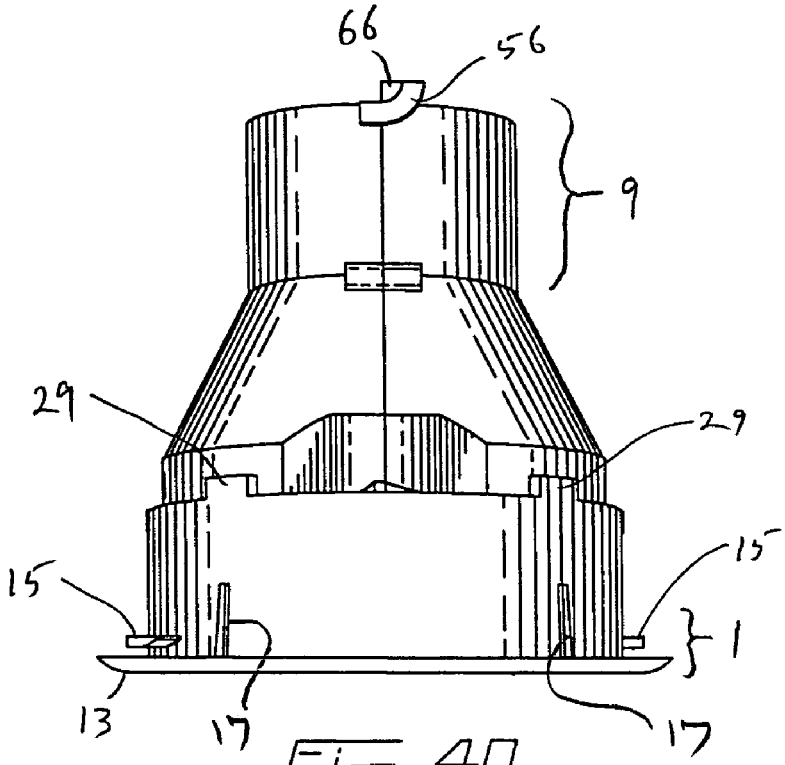
Figure 41:
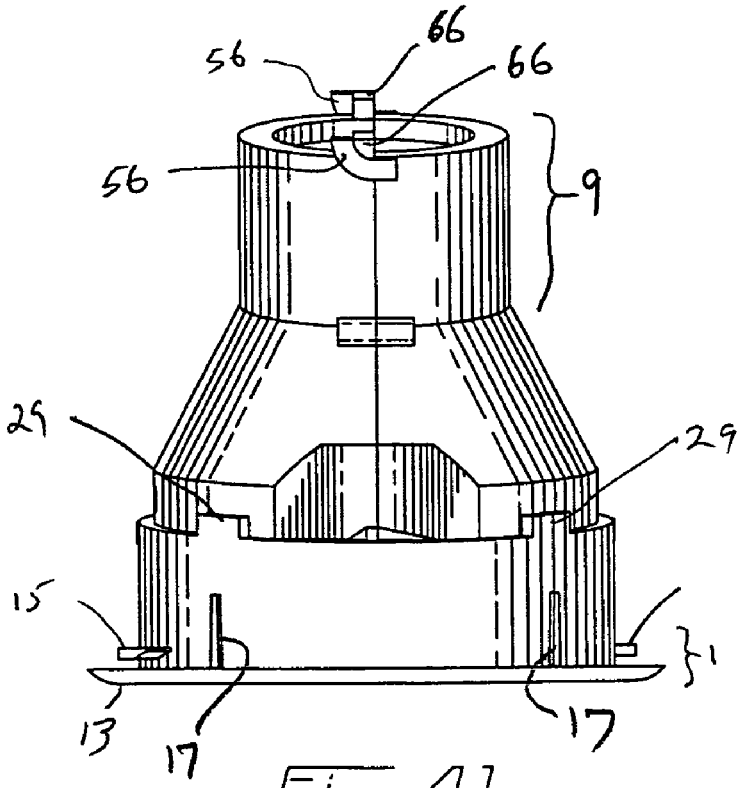
Figure 42:
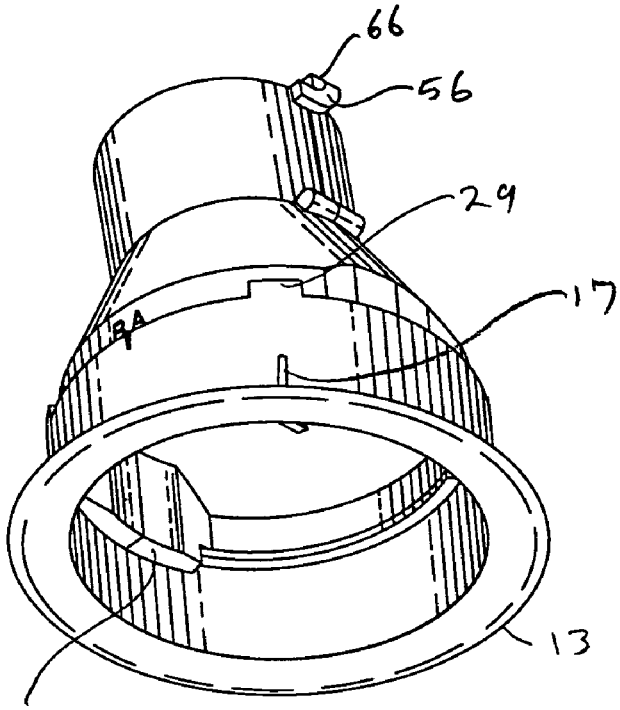
FIG. 42 is a bottom perspective view of the lamp housing assembly of FIG. 36.

As may be seen from FIGS. 27 and 28 the alignment of both of the letters B with the notches is indicative of a parallel axis orientation (i.e. B-B alignment) whereas as may be seen from FIGS. 38 and 39 the alignment of both of the letters A with the notches is indicative of an oblique axis orientation (i.e. A-A alignment).

Figure 22:
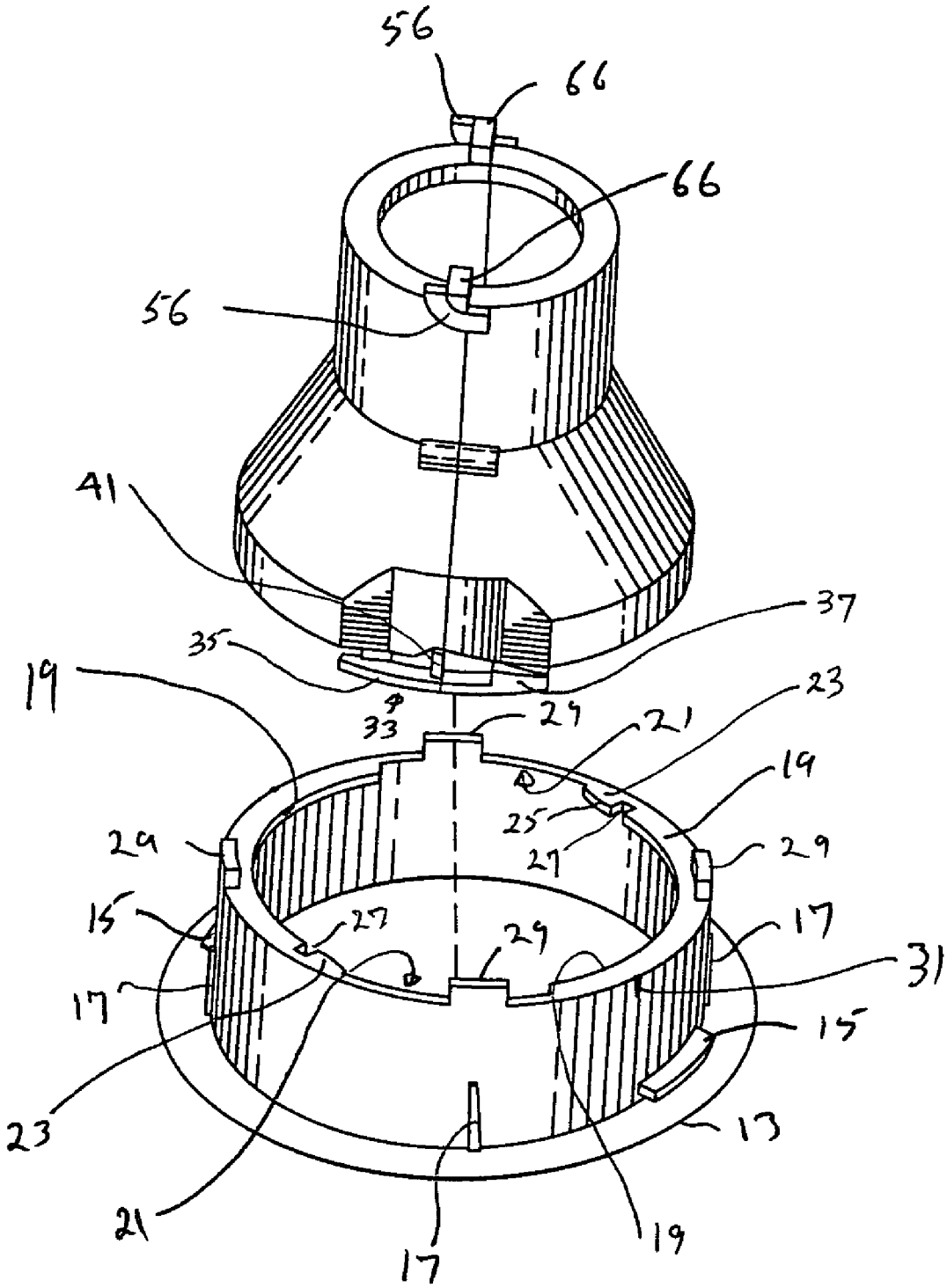
FIG. 22 is a top perspective view of the lamp socket holder housing of FIG. 9 and the mounting ring of FIG. 16A in the process of being juxtaposed oblique rim member to oblique rim member for perpendicular B-B alignment.
Figure 23:
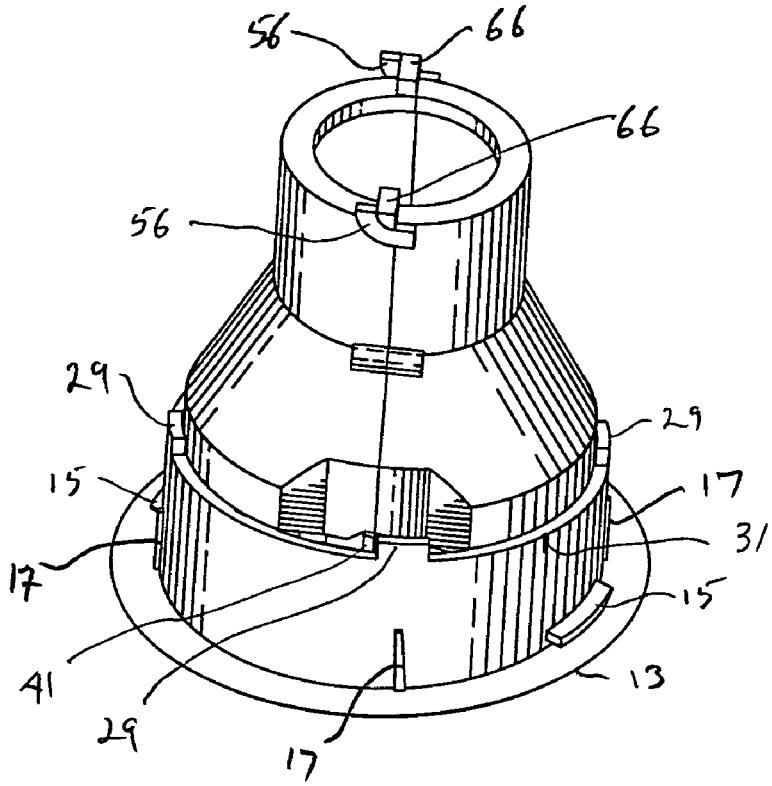
FIG. 23 is a top perspective view of the lamp socket holder housing of FIG. 9 and the mounting ring of FIG. 16A in abutting engagement prior to interlocking thereof for perpendicular B-B alignment.
Figure 24:
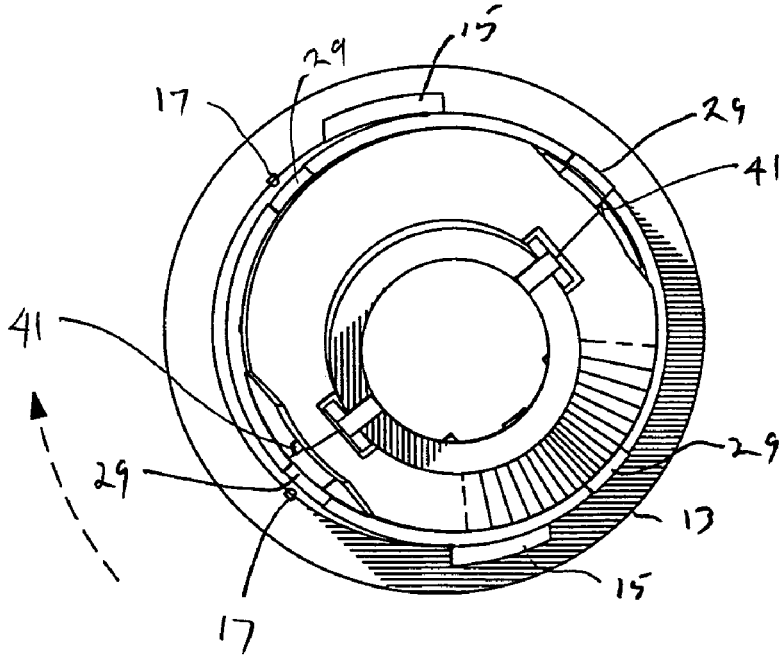
FIG. 24 is a top view of the pre-interlocked assembly of FIG. 23 indicating the direction of rotation of the lamp socket holder housing relative to the underlying mounting ring to effect interlock of the lamp assembly components in perpendicular B-B alignment.
Figure 26:
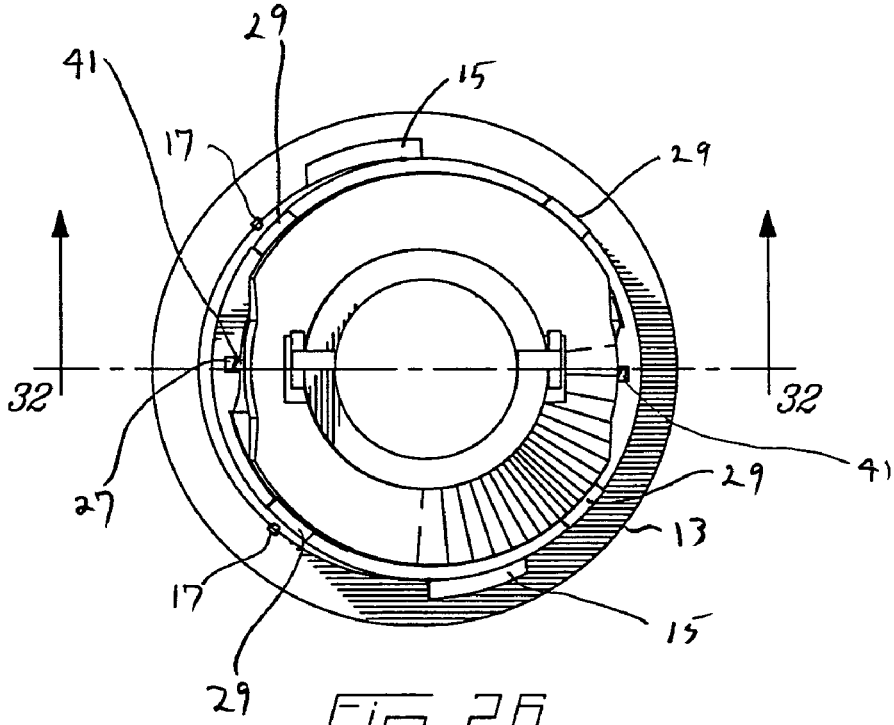
FIG. 26 is a top view of the lamp housing assembly of FIG. 25.
Figure 44:
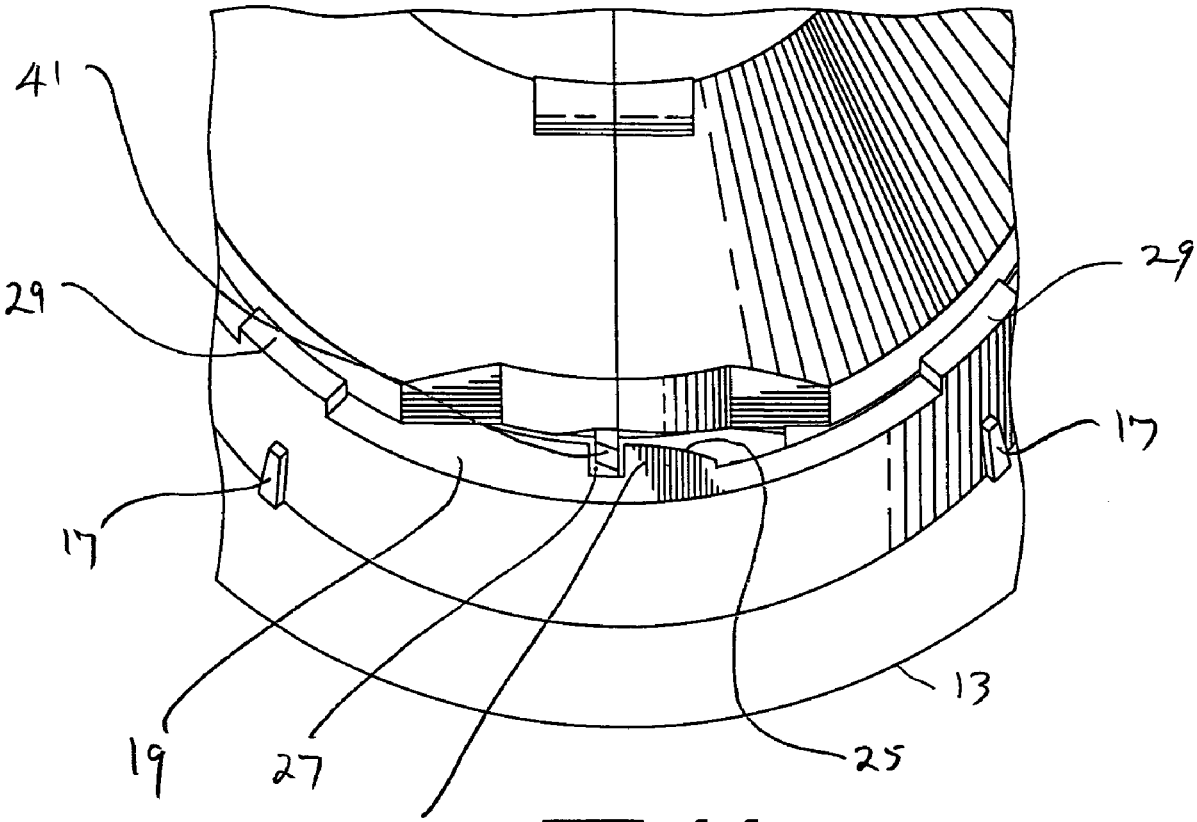
FIG. 44 is an enlarged view of the interconnected snap lock means for the assembly of FIG. 25 and FIG. 36.

Referring to FIGS. 22 to 26, the mounting ring and lamp socket holder housing may be interlocked in a parallel axis orientation by juxtaposing the lower rim member 7 of the lamp socket holder housing with the upper rim member 3 of the mounting ring as shown in FIG. 22 and registering the retainer legs 33 of the lamp socket holder housing in the opposed passageways 21 of the mounting ring as shown in FIG. 23 in anticipation of the B-B alignment. The lamp socket holder housing is then rotated in the direction of the arrow as shown in FIG. 24 so as to bring the axial retainer members 35 under the respective retainer flange members 19 until the latch projection members 41 snap into respective lock notches 27 so as to interlock the two assembly components together as shown in FIGS. 25 and 26. The interlock disposition is shown in more detail in FIG. 44 (see FIG. 32 as well) which shows an enlarged view of the interlock relationship mechanism between the mounting ring and the lamp socket holder housing.

Figure 33:
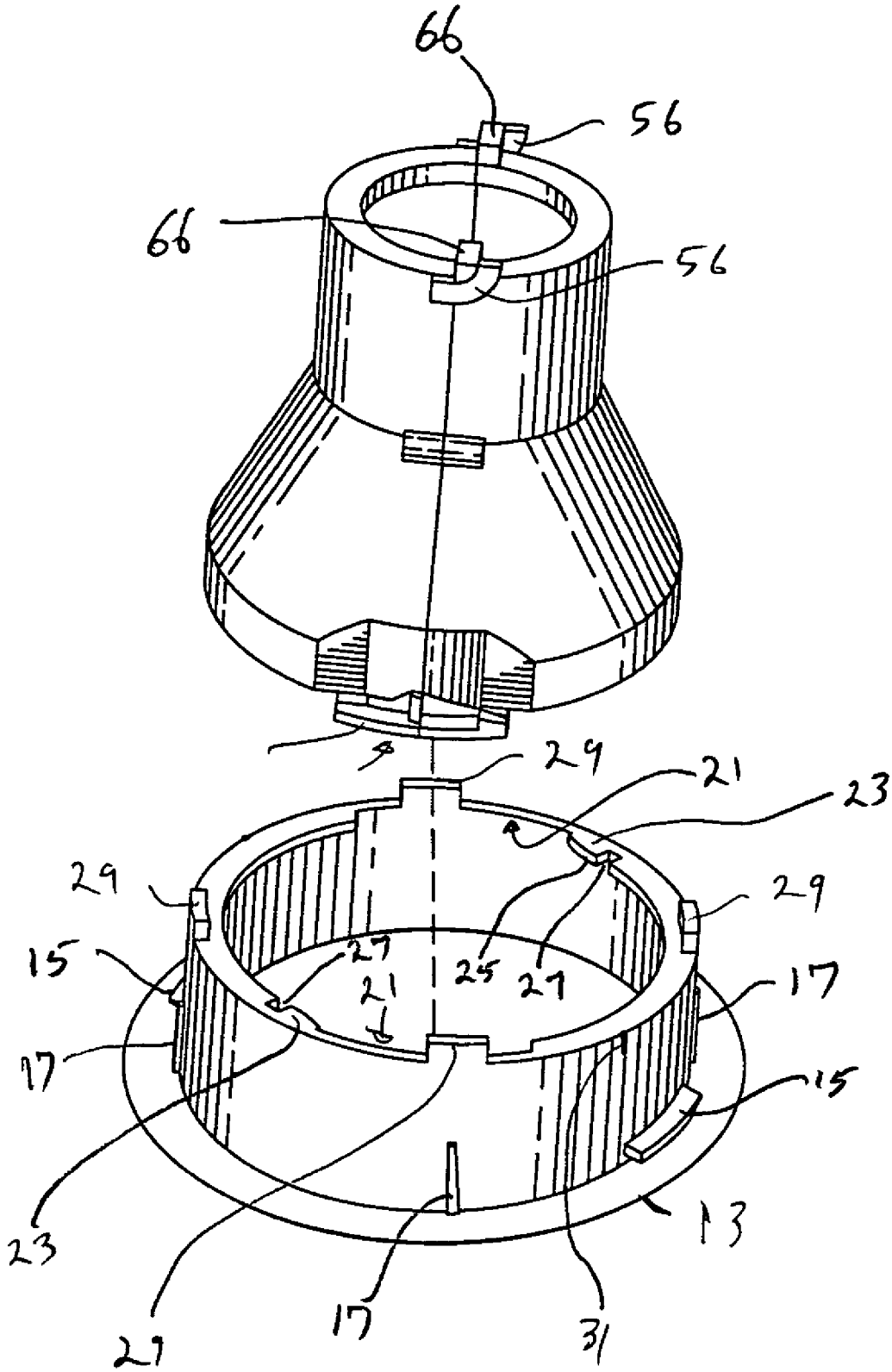
FIG. 33 is a top perspective view of the lamp socket holder housing of FIG. 9 and the mounting ring of FIG. 16A in the process of being juxtaposed oblique rim member to oblique rim member for oblique A-A alignment.
Figure 34:
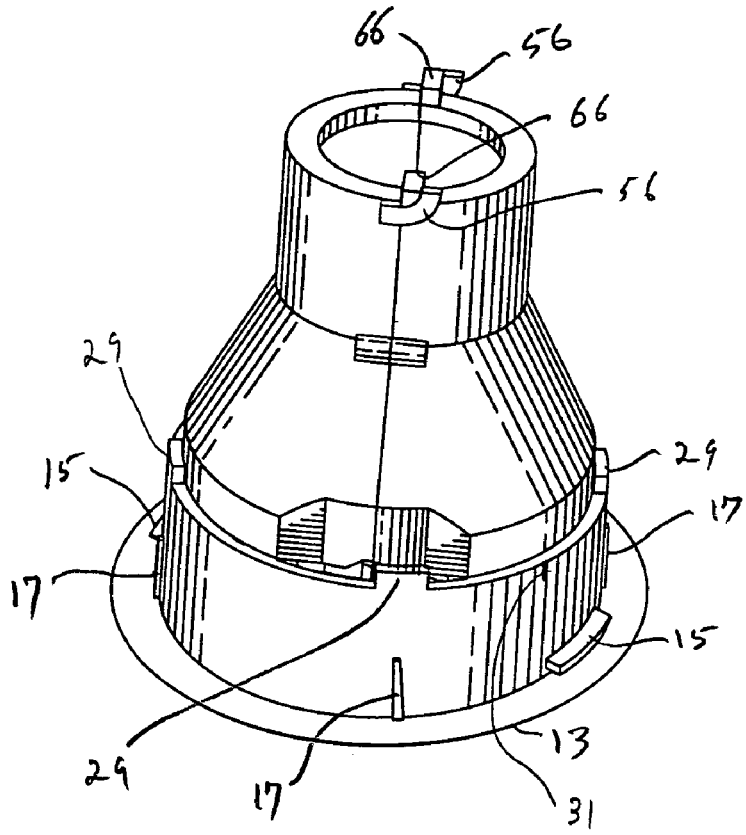
FIG. 34 is a top perspective view of the lamp socket holder housing of FIG. 9 and the mounting ring of FIG. 16A in abutting engagement prior to interlocking thereof for oblique A-A alignment.

Referring to FIGS. 33 to 37, the mounting ring and lamp socket holder housing may be interlocked in an oblique axis orientation by juxtaposing the lower rim member 7 of the lamp socket holder housing with the upper rim member 3 of the mounting ring as shown in FIG. 33 and registering the retainer legs 33 of the lamp socket holder housing in the opposed passageways 21 of the mounting ring as shown in FIG. 34 in anticipation of the A-A alignment. Thereafter the assembly follows the same steps as for the B-B alignment but with reference to FIGS. 35 to 37 (as well as FIGS. 43 and 44).

Figure 35:
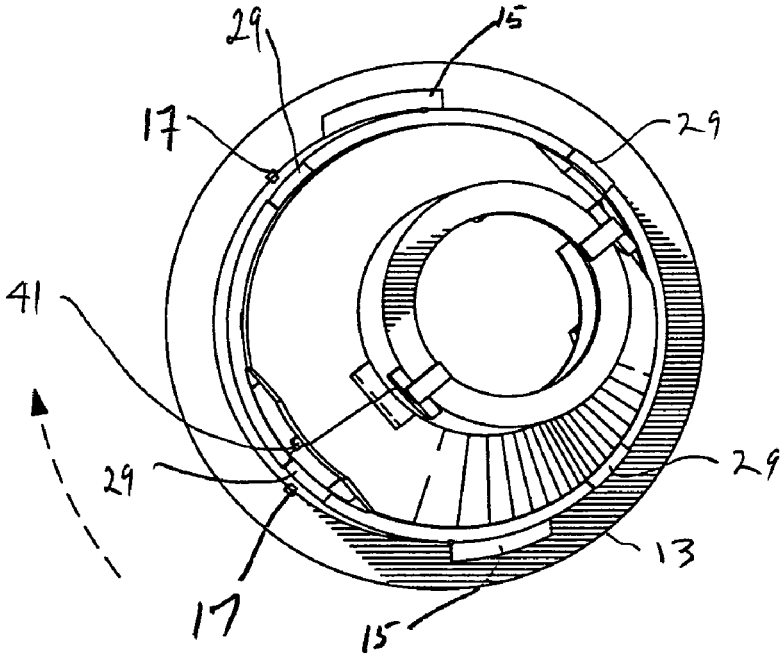
FIG. 35 is a top view of the pre-interlocked assembly of FIG. 34 indicating the direction of rotation of the lamp socket holder housing relative to the underlying mounting ring to effect interlock of the lamp assembly components in oblique A-A alignment.

Advantageously the lamp socket holder housing may be of any suitable material (e,g, plastics material) such that at least the portions thereof associated with each of the latch projection members 41 is sufficiently flexible so as to allow for these members to be manually pressed inwardly sufficiently to be cleared of the lock notches 27 so that the lamp socket holder housing may be rotated in a direction opposite to that shown by the arrows in FIGS. 24 and 35. In this way the two components may be disengaged by pulling them apart once the retainer legs of the lamp socket holder housing are again registered in the opposed passageways of the mounting ring. This feature is advantage in that the assembly may as desired or necessary be converted from one alignment orientation to the other.

Figure 1:
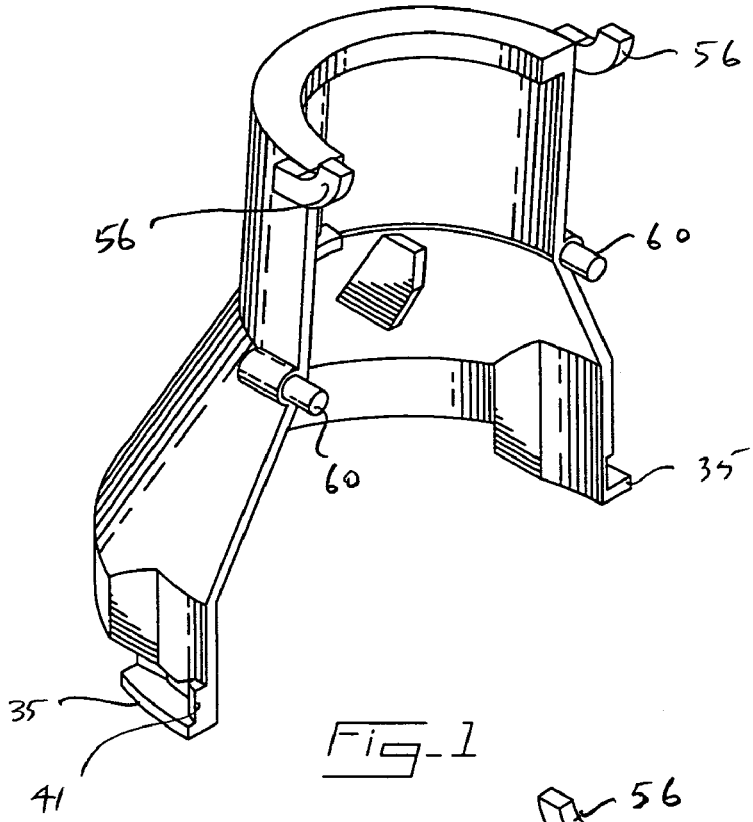
FIGS. 1 and 2 are top perspective views of a half element of an example lamp socket holder housing taken from the inner and outer sides respectively.
Figure 2:
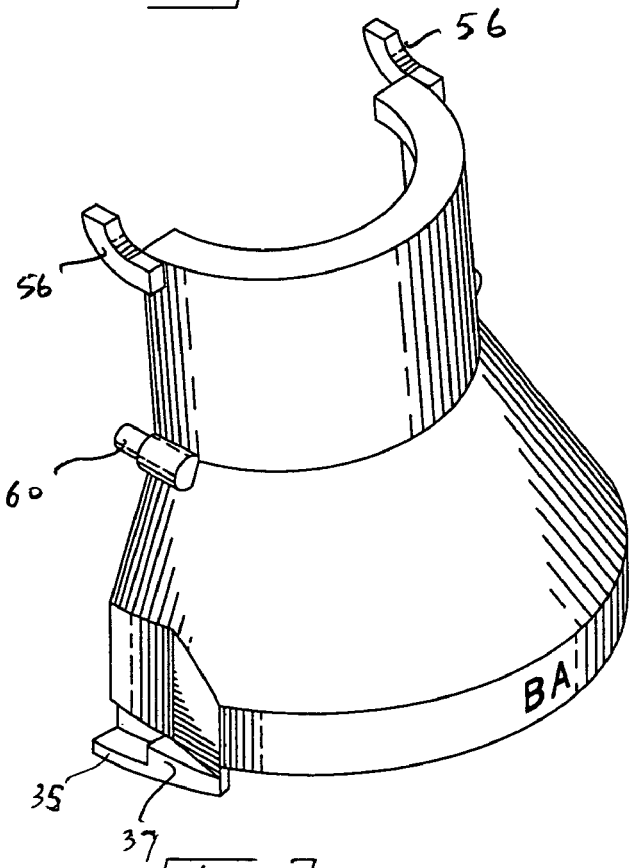
Figure 3:
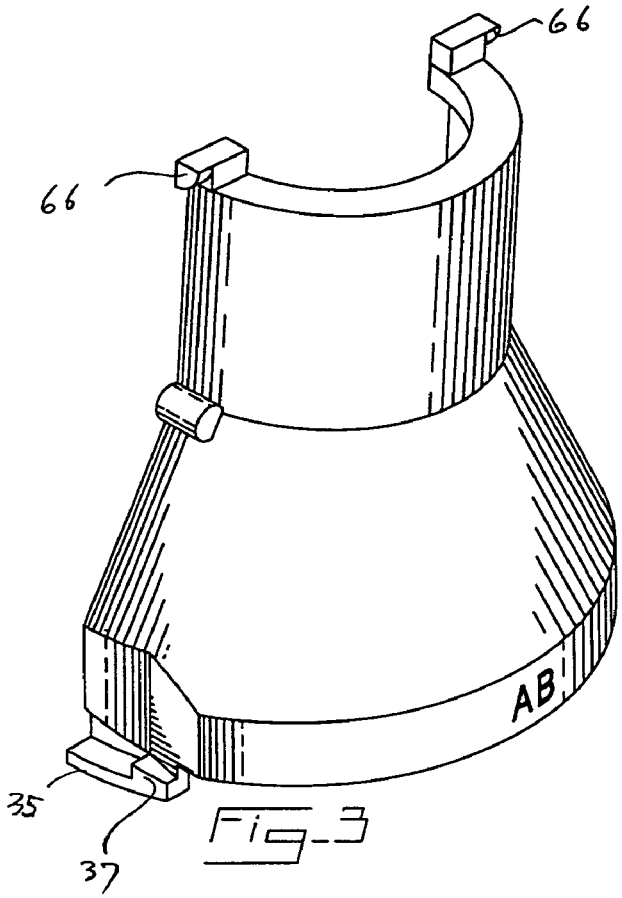
FIGS. 3 and 4 are top perspective views of the other half element for the example lamp socket holder housing which are also taken from the inner and outer sides respectively.
Figure 4:
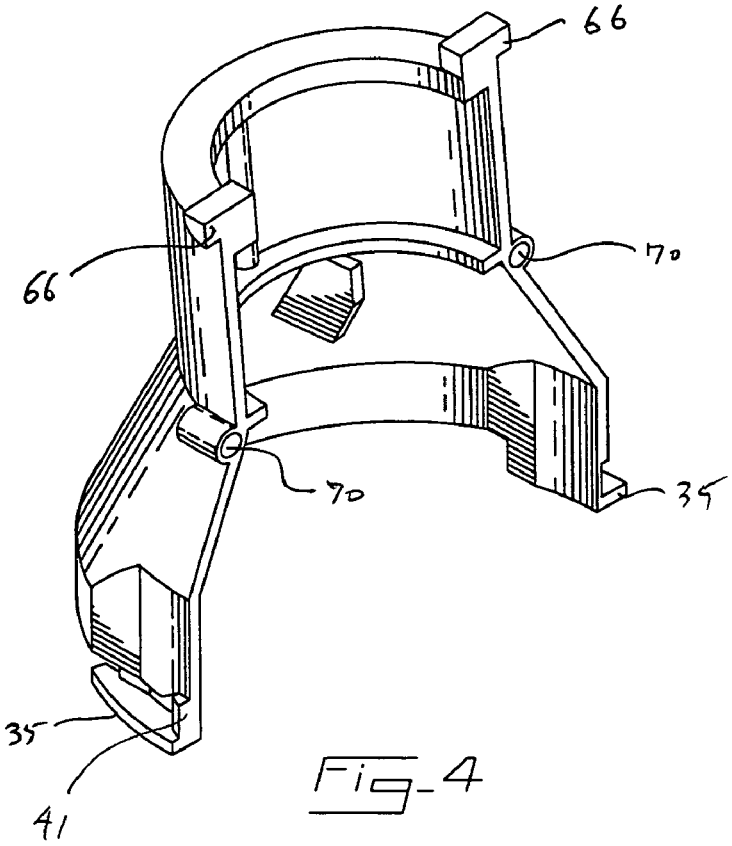
Figure 8:
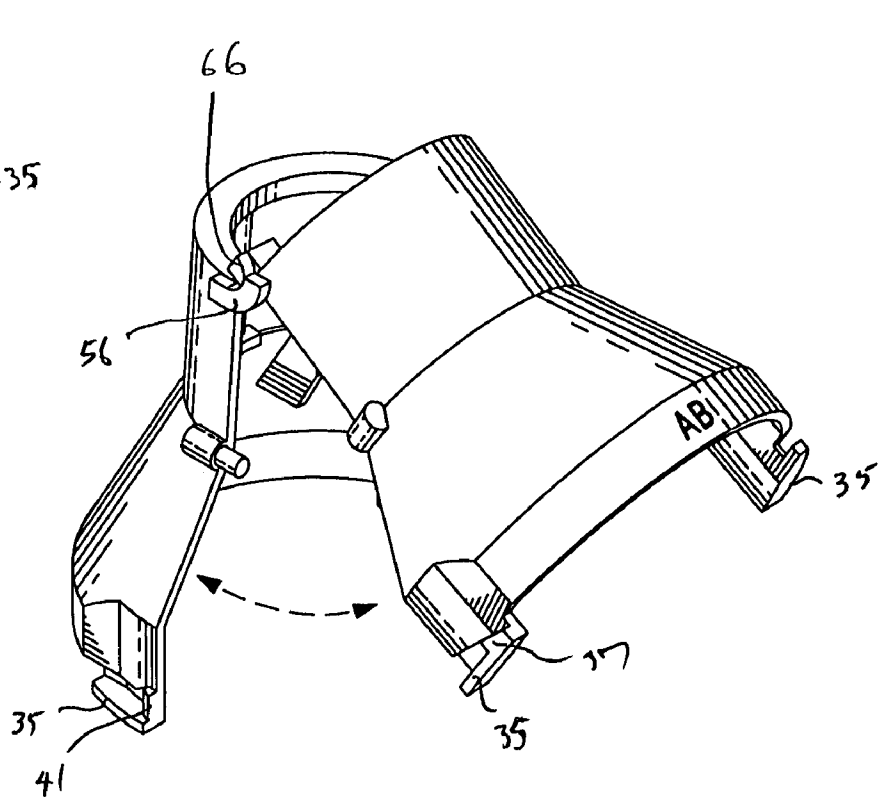
FIGS. 7 and 8 illustrate the pivot engagement of the two half elements of FIGS. 1 to 4 to form the example lamp socket holder housing.
Figure 7:
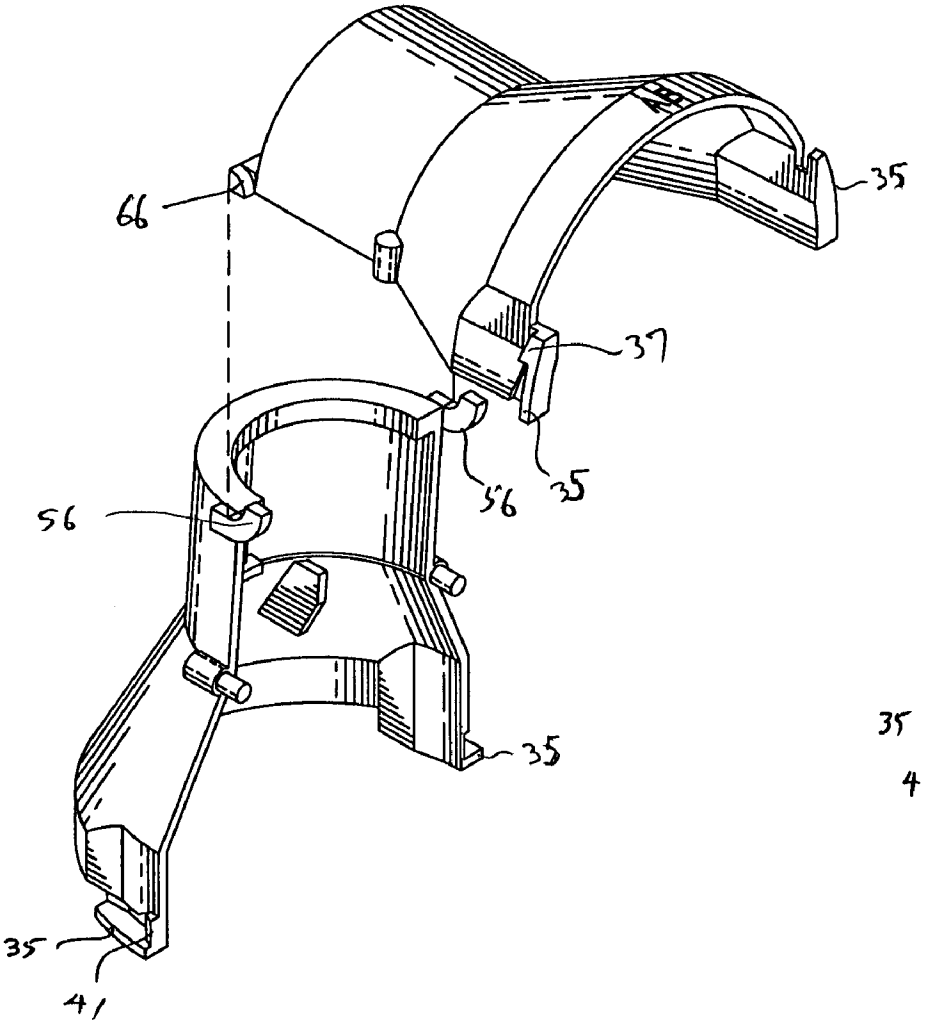

Referring back to FIGS. 1 to 9, as may be seen the lamp socket holder housing may itself comprise two half elements. One half element comprises pivot arms 56 as well as male pin alignment projections 60 (FIGS. 1 and 2). The other half element comprises pivot pins 66 for engagement with the pivot arms 56 and female openings 70 for engagement with the alignment pin projections 60. The two half elements may be engaged as illustrated in FIGS. 7 and 8 to obtain the assembled lamp socket holder housing as seen in FIG. 9. As may be seen from these figures the half elements also include respective half portions of the retainer legs of the lamp socket holder housing.

Figure 45:
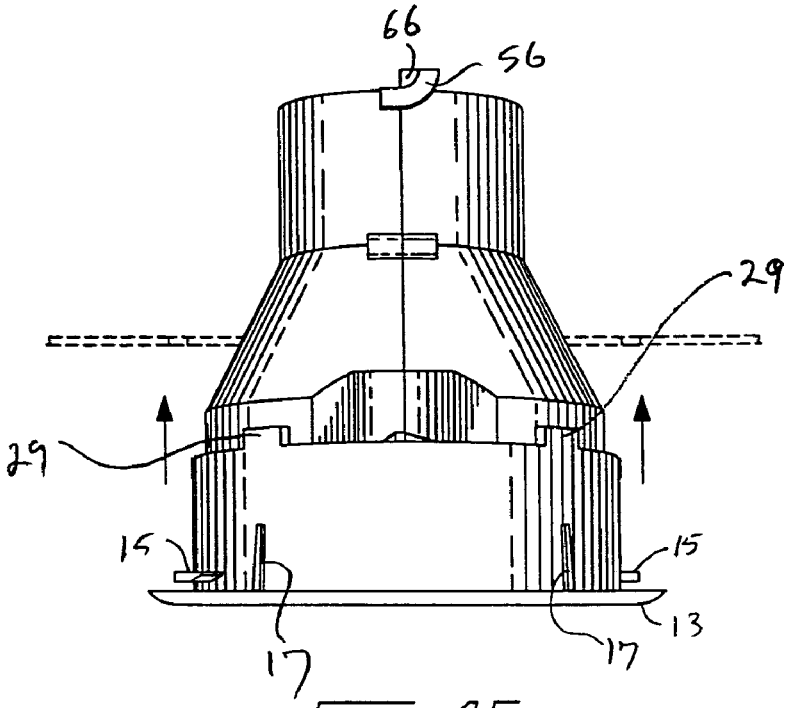
FIG. 45 shows a lamp housing assembly of the present invention in the process of being engaged with an opening in the underside of a wall panel of a kitchen hood.
Figure 46:
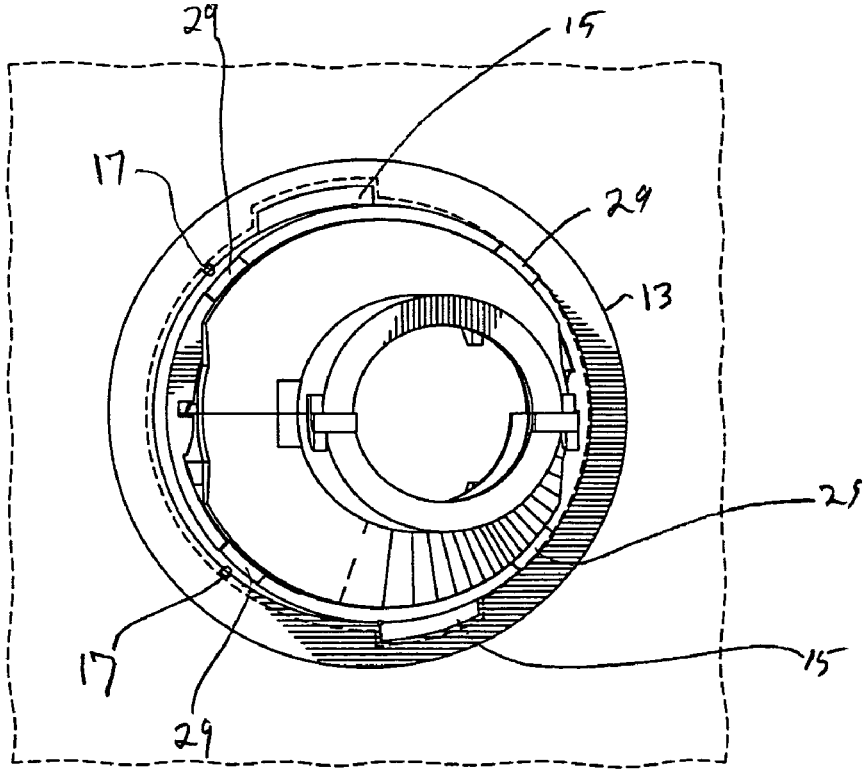
FIG. 46 shows the lamp housing assembly of FIG. 45 disposed in the opening in the underside of the wall panel of a kitchen hood prior to rotation thereof in the opening.

Referring to FIGS. 45 and 46 the assembled lamp housing assembly may be connected to a wall panel (shown in dotted outline) of a kitchen hood by providing the wall panel with an opening large enough to accommodate the mounting ring. So that the assembly may be pushed into the opening as shown in FIG. 45. The opening in the wall panel is also provided with notch openings configured to allow the registration therewith of the side wall projections of the mounting ring. Once the trim ring abuts the wall panel the assembly is rotated in the opening so that the wall panel is pinched between the trim ring and the side wall projections, The wedge also provide a press fit function to assist in the engagement of the lamp housing assembly in the wall panel opening. Prior to engagement in the wall panel opening a socket may be installed in the lamp socket holder housing in any suitable or desired fashion.

The invention claimed is:

1. A lamp housing assembly comprising a mounting ring interlocked with a lamp socket holder housing wherein said mounting ring comprises a lower rim member and an oblique upper rim/border member, said lower rim member having a predetermined longitudinal, first, lamp orientation axis, said oblique upper rim/border member being disposed obliquely with respect to said first lamp orientation axis, said oblique upper rim/border member comprising a first snap interlock element, wherein said lamp socket holder housing comprises an upper lamp/socket housing member and an oblique lower rim member, said upper lamp/socket housing member having a predetermined longitudinal, second, lamp orientation axis, said oblique lower rim member being disposed obliquely with respect to said second lamp orientation axis, said oblique lower rim member comprising a second snap interlock element and wherein the mounting ring and the lamp socket holder housing are configured such that the first and second snap interlock elements releasably interlock together the mounting ring and the lamp socket holder housing in a first configuration or in a second configuration, wherein when said mounting ring and said lamp socket holder housing are interlocked together in said first configuration the lamp socket holder housing is oriented such that the second lamp orientation axis is parallel to the first lamp orientation axis and wherein when said mounting ring and said lamp socket holder housing are interlocked together in said second configuration the lamp socket holder housing is oriented such that the second lamp orientation axis is oblique to the first lamp orientation axis.

2. A lamp socket holder housing for a lamp housing assembly comprising said lamp socket holder housing interlocked with a mounting ring, said mounting ring comprising a lower rim member and an oblique upper rim/border member, said lower rim member having a predetermined longitudinal, first, lamp orientation axis, said oblique upper rim/border member being disposed obliquely with respect to said first lamp orientation axis, said oblique upper rim/border member comprising first snap interlock element, said lamp socket holder housing comprising an upper lamp/socket housing member and an oblique lower rim member, said upper lamp/socket housing member having a predetermined longitudinal, second, lamp orientation axis, said oblique lower rim member disposed obliquely with respect to said second lamp orientation axis, said oblique lower rim member comprising a second snap interlock element, and the oblique lower rim member of said lamp socket holder housing being configured to cooperate with the oblique upper rim/border member of said mounting ring such that the first and second snap interlock elements are able to interlock together the mounting ring and the lamp socket holder housing in a first configuration or in a second configuration, wherein when said mounting ring and said lamp socket holder housing are interlocked together in said first configuration the lamp socket holder housing is oriented relative to said mounting ring such that the second lamp orientation axis is parallel to the first lamp orientation axis and wherein when said mounting ring and said lamp socket holder housing are interlocked together in said second configuration the lamp socket holder housing is oriented relative to said mounting ring such that the second lamp orientation axis is oblique to the first lamp orientation axis.

3. A mounting ring for a lamp housing assembly comprising said mounting ring interlocked with a lamp socket holder housing, said lamp socket holder housing comprising an upper lamp/socket housing member and an oblique lower rim member, said upper lamp/socket housing member having a predetermined longitudinal, second, lamp orientation axis, said oblique lower rim member disposed obliquely with respect to said second lamp orientation axis, said oblique lower rim member comprising a second snap interlock element wherein said mounting ring comprises a lower rim member and an oblique upper rim/border member, said lower rim member having a predetermined longitudinal, first, lamp orientation axis, said oblique upper rim/border member disposed obliquely with respect to said first lamp orientation axis, said oblique upper rim/order member comprising first snap interlock element, the oblique upper rim/border member of said mounting ring being configured to cooperate with the oblique lower rim member of said lamp socket holder housing such that the first and second snap interlock elements are able to interlock together the mounting ring and the lamp socket holder housing in a first configuration or in a second configuration, wherein when said mounting ring and said lamp socket holder housing are interlocked together in said first configuration the lamp socket holder housing is oriented such that the second lamp orientation axis is parallel to the first lamp orientation axis and wherein when aid mounting ring and said lamp socket holder housing are interlocked together in said second configuration the lamp socket holder housing is oriented such that the second lamp orientation axis is oblique to the first lamp orientation axis.

4. A kit for a lamp housing assembly, said kit comprising a mounting ring and a lamp socket holder housing wherein said mounting ring comprises a lower rim member and an oblique upper rim/border member, said lower rim member having a predetermined longitudinal, first, lamp orientation axis, said oblique upper rim/border member being disposed obliquely with respect to said first lamp orientation axis, said oblique upper rim/border member comprising a first snap interlock element, wherein said lamp socket holder housing comprises an upper lamp/socket housing member and an oblique lower rim member, said upper lamp/socket housing member having a predetermined longitudinal, second, lamp orientation axis, said oblique lower rim member being disposed obliquely with respect to said second lamp orientation axis, said oblique lower rim member comprising a second snap interlock element and wherein the mounting ring and the lamp socket holder housing are configured such that the first and second snap interlock elements are able to releasably interlock together the mounting ring and the lamp socket holder housing in a first configuration or in a second configuration, wherein when said mounting ring and said lamp socket holder housing are interlocked together in said first configuration the lamp socket holder housing is oriented such that the second lamp orientation axis is parallel to the first tamp orientation axis and wherein when said mounting ring and said lamp socket holder housing are interlocked together in said second configuration the lamp socket holder housing is oriented such that the second lamp orientation axis is oblique to the first lamp orientation axis.

* * * * *